US011653136B2

(12) United States Patent
Li et al.

(10) Patent No.: US 11,653,136 B2
(45) Date of Patent: May 16, 2023

(54) SPEAKER DEVICE

(71) Applicant: SHENZHEN SHOKZ CO., LTD., Guangdong (CN)

(72) Inventors: Chaowu Li, Shenzhen (CN); Zhuyang Jiang, Shenzhen (CN); Fen You, Shenzhen (CN)

(73) Assignee: SHENZHEN SHOKZ CO., LTD., Shenzhen (CN)

( * ) Notice: Subject to any disclaimer, the term of this patent is extended or adjusted under 35 U.S.C. 154(b) by 160 days.

(21) Appl. No.: 17/305,241

(22) Filed: Jul. 1, 2021

(65) Prior Publication Data

US 2021/0329371 A1 Oct. 21, 2021

Related U.S. Application Data

(63) Continuation of application No. PCT/CN2019/102384, filed on Aug. 24, 2019.

(30) Foreign Application Priority Data

Jan. 5, 2019 (CN) ..... 201910009887.3

(51) Int. Cl.
*H04R 25/00* (2006.01)
*H04R 1/10* (2006.01)
(Continued)

(52) U.S. Cl.
CPC ..... *H04R 1/1041* (2013.01); *H04R 1/026* (2013.01); *H04R 1/10* (2013.01); *H04R 1/105* (2013.01);
(Continued)

(58) Field of Classification Search
CPC .... H04R 1/1016; H04R 1/44; H04R 2420/07; H04R 1/02; H04R 1/26; H04R 1/1075;
(Continued)

(56) References Cited

U.S. PATENT DOCUMENTS 10,897,677 B2 * 1/2021 Walraevens ..... H04R 25/606
2016/0007127 A1 1/2016 Kennes et al.
(Continued)

FOREIGN PATENT DOCUMENTS

CN 105007551 A 10/2015
CN 109121038 A 1/2019
(Continued)

OTHER PUBLICATIONS

International Search Report in PCT/CN2019/102384 dated Nov. 29, 2019, 9 pages.
(Continued)

*Primary Examiner* — Amir H Etesam
(74) *Attorney, Agent, or Firm* — Metis IP LLC

(57) ABSTRACT

The present disclosure relates to a speaker device including a core housing. The core housing may accommodate an earphone core. An absolute value of a difference between a first phase of a vibration of a housing panel of the core housing caused by the earphone core and a second phase of the housing back of the core housing caused by the earphone core may be less than 60 degrees when a frequency of each of the vibration of the housing panel and the vibration of the housing back is between 2000 Hz and 3000 Hz. A button may be disposed at a button hole on the circuit housing, and move relative to the button hole to generate a control signal for a control circuit to cause the earphone core to vibrate to generate a sound. An elastic pad may be disposed between the button and the button hole.

20 Claims, 14 Drawing Sheets

(51) Int. Cl.
*H04R 1/02* (2006.01)
*H04R 1/28* (2006.01)

(52) U.S. Cl.
CPC ..... *H04R 1/1008* (2013.01); *H04R 1/1066* (2013.01); *H04R 1/1075* (2013.01); *H04R 1/1091* (2013.01); *H04R 1/28* (2013.01); *H04R 2460/13* (2013.01)

(58) Field of Classification Search
CPC H04R 1/1091; H04R 1/1041; H04R 2460/13; H04R 1/1066; H04R 1/105
See application file for complete search history.

(56) References Cited

U.S. PATENT DOCUMENTS

| | | | |
|---|---|---|---|
| 2016/0329041 | A1 | 11/2016 | Qi et al. |
| 2021/0014602 | A1 | 1/2021 | Li et al. |
| 2021/0168493 | A1 | 6/2021 | Zheng et al. |

FOREIGN PATENT DOCUMENTS

| | | | |
|---|---|---|---|
| CN | 110022516 | A | 7/2019 |
| WO | 2015096434 | A1 | 7/2015 |

OTHER PUBLICATIONS

Written Opinion in PCT/CN2019/102384 dated Nov. 29, 2019, 10 pages.

* cited by examiner

1100

2600

2700

SPEAKER DEVICE

CROSS REFERENCE TO RELATED APPLICATIONS

This application is a Continuation of International Patent Application No. PCT/CN2019/102384, filed on Aug. 24, 2019, which claims priority of Chinese Patent Application No. 201910009887.3, filed on Jan. 5, 2019, and the entire contents of each of which are incorporated herein by reference.

TECHNICAL FIELD

The present disclosure relates to a speaker device, and in particular, to a speaker device with a waterproof function.

BACKGROUND

In general, people can hear the sound because the air transmits vibration to the eardrum through the external ear canal, and the vibration formed by the eardrum drives the human auditory nerve, and people can perceive the vibration of the sound. At present, earphones are widely used in people's lives. For example, users can use earphones to play music, answer calls, etc. Earphones have become an important item in people's daily life. Generally, earphones in the market may not satisfy user's requirements on some occasions. For example, a user may need to control an earphone when the user is swimming, or when the user is outdoor on rainy days, etc. Earphones with waterproof function and good sound quality are more popular. Therefore, it is desirable to provide a speaker device with a waterproof function.

SUMMARY

According to an aspect of the present disclosure, a speaker device is provided. The speaker device may include a core housing, a circuit housing, a button, an elastic pad, and an ear hook. The core housing may be configured to accommodate an earphone core. The core housing may include a housing panel facing a human body and a housing back opposite to the housing panel. The earphone core may be configured to cause the housing panel and the housing back to vibrate. A vibration of the housing panel may have a first phase, a vibration of the housing back may have a second phase, and an absolute value of a difference between the first phase and the second phase may be less than 60 degrees when a frequency of each of the vibration of the housing panel and the vibration of the housing back is between 2000 Hz and 3000 Hz. The circuit housing may be configured to accommodate a control circuit. The control circuit may be configured to cause the earphone core to vibrate to generate a sound. The button may be disposed at a button hole on the circuit housing. The button may move relative to the button hole to generate a control signal for the control circuit. The elastic pad may be disposed between the button and the button hole. The elastic pad may be configured to hinder a movement of the button relative to the button hole. The ear hook may be configured to connect the core housing and the circuit housing.

In some embodiments, the circuit housing may include a main sidewall and an auxiliary sidewall connected to the main sidewall. A first recessed area may be disposed on the auxiliary sidewall. The elastic pad may be disposed in the first recessed area. The elastic pad may include a second recessed area corresponding to the button hole. The second recessed area may extend to an inside of the button hole.

In some embodiments, the button may include a button body and a button contact. The button contact may extend into the second recessed area. The button body may be disposed on a side of the button contact away from the elastic pad.

In some embodiments, the circuit housing may accommodate a button circuit board. A button switch corresponding to the button hole may be disposed on the button circuit board. The button contact may be configured to contact with and trigger the button switch when a user presses the button.

In some embodiments, the button may include at least two button units disposed apart from each other and a connection part configured to connect the at least two button units. The elastic pad may include an elastic convex configured to support the connection part.

In some embodiments, the speaker device may include a rigid pad. The rigid pad may be disposed between the elastic pad and the circuit housing. The rigid pad may include a through hole through which the second recessed area may pass.

In some embodiments, the elastic pad and the rigid pad may be fixed against each other.

In some embodiments, the ear hook may be plugged and fixed to the circuit housing. A housing sheath may be moulded on the ear hook. The housing sheath may be wrapped around a periphery of the circuit housing and a periphery of the button in a sleeved manner.

In some embodiments, the housing sheath may include a bag-like structure with an opening end. The circuit housing and the button may enter into the housing sheath through the opening end of the housing sheath.

In some embodiments, the opening end of the housing sheath may include an annular flange protruding inwardly. An end of the circuit housing away from the ear hook may have a stepped structure to form an annular table. The annular flange may abut on the annular table when the housing sheath covers the periphery of the circuit housing.

In some embodiments, a sealant may be applied to a joint area between the annular flange and the annular table to connect the housing sheath and the circuit housing in a sealed manner.

In some embodiments, the speaker device may include an auxiliary film. The auxiliary film may include a board and a pressing foot protruding with respect to the board. The pressing foot may be configured to press the button circuit board on an inner surface of the auxiliary sidewall.

In some embodiments, at least one mounting hole may be disposed on the circuit housing. The speaker device may further include at least one conductive post each of which is inserted into one mounting hole of the at least one mounting hole. A hollow region may be disposed on the board. The board may be disposed on an inner surface of the circuit housing. The at least one mounting hole may be disposed inside the hollow region to form a glue tank on a periphery of the at least one conductive post.

In some embodiments, the hollow region may include a notch. A striped convex rib corresponding to the notch may be integrally formed on an inner surface of the main sidewall. The striped convex rib may cooperate with the auxiliary film to make the glue tank closed.

In some embodiments, the vibration of the housing panel may have a first amplitude, the vibration of the housing back may have a second amplitude, and a ratio of the first amplitude to the second amplitude may be within a range of 0.5 to 1.5.

In some embodiments, the vibration of the housing panel may generate a first leaked sound wave. The vibration of the housing back may generate a second sound leakage sound wave. The first leaked sound wave and the second leaked sound wave may overlap to reduce an amplitude of the first leaked sound wave.

In some embodiments, the housing panel and one or more other components of the core housing may be connected via at least one of a bonding connection, a snapping connection, a welding connection, or a threaded connection.

In some embodiments, the housing panel or the housing back may be made of fiber reinforced plastic material.

In some embodiments, the vibration caused by the earphone core may generate a driving force. The housing panel may be connected to the earphone core via a transmission connection. At least a portion of the housing panel may be connected to or abut against the human body of a user to transmit sound. An area of the housing panel contacted with or abutting against the human body may include a normal line. A line where the driving force locates may be not parallel to the normal line.

In some embodiments, a positive direction of the line where the driving force locates is set outwards the speaker device from the housing panel, a positive direction of the normal line is set outwards the speaker device, and an angle formed between the positive direction of the line and the positive direction of the normal line may be an acute angle.

In some embodiments, the earphone core may include a coil and a magnetic circuit assembly. An axis of the coil or an axis of the magnetic circuit assembly may be not parallel to the normal line. The axis of the coil or the axis of the magnetic circuit assembly may be perpendicular to a radial plane of the coil and/or a radial plane of the magnetic circuit assembly.

In some embodiments, the driving force may have a component in a first quadrant and/or a third quadrant of an XOY plane coordinate system, an origin of the XOY plane coordinate system may be located on a contact surface between the speaker device and the human body, an X-axis of the XOY plane coordinate system may be parallel to a coronal axis of the human body, a Y-axis may be parallel to a sagittal axis of the human body, and a positive direction of the X-axis may face outside of the human body, and a positive direction of the Y-axis may face the front of the human body.

In some embodiments, the area of the housing panel connected with or abuting against the human body may include a plane or a quasi-plane.

In some embodiments, the earphone core may further include a magnetic circuit assembly. The magnetic circuit assembly may generate a first magnetic field. The magnetic circuit assembly may include a first magnetic unit, a first magnetically conductive unit, and at least one second magnetic unit. The first magnetic unit may generate a second magnetic field. The at least one second magnetic unit may surround the first magnetic unit. A magnetic gap may be formed between the first magnetic unit and the at least one second magnetic unit. An intensity of the first magnetic field in the magnetic gap may be greater than an intensity of the second magnetic field in the magnetic gap.

In some embodiments, the speaker device may further include a second magnetically conductive unit and at least one third magnetic unit. The at least one third magnetic unit may be connected to the second magnetically conductive unit and the at least one second magnetic unit.

In some embodiments, the speaker device may further include at least one fourth magnetic unit. The at least one fourth magnetic unit may be disposed below the magnetic gap and connected to the first magnetic unit and the second magnetically conductive unit.

In some embodiments, the speaker device may further include at least one fifth magnetic unit. The at least one fifth magnetic unit may be connected to an upper surface of the first magnetically conductive unit.

In some embodiments, the speaker device may further include a third magnetically conductive unit. The third magnetically conductive unit may be connected to an upper surface of the fifth magnetic unit and configured to suppress leakage of magnetic induction lines of the first magnetic field.

In some embodiments, the first magnetically conductive unit may be connected to an upper surface of the first magnetic unit. The second magnetically conductive unit may include a bottom plate and a sidewall. The first magnetic unit may be connected to the bottom plate of the second magnetically conductive unit.

In some embodiments, the speaker device may further include at least one conductive unit. The at least one conductive unit may be connected to at least one of the first magnetic unit, the first magnetically conductive unit, or the second magnetically conductive unit.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities, and combinations set forth in the detailed examples discussed below.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein.

DETAILED DESCRIPTION

Figure 1:
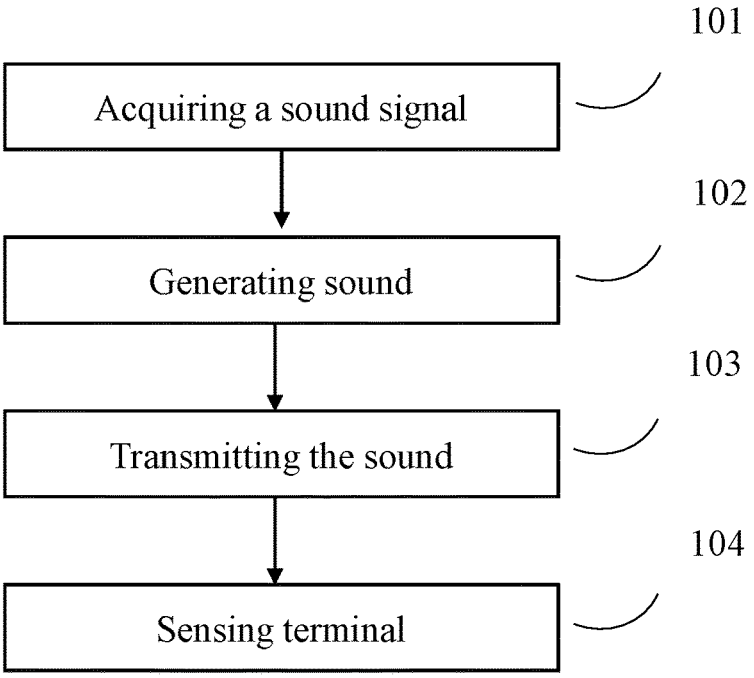
FIG. 1 is a flowchart illustrating an exemplary process for generating auditory sense through a speaker device according to some embodiments of the present disclosure.

In order to illustrate the technical solutions related to the embodiments of the present disclosure, brief introduction of the drawings referred to in the description of the embodiments is provided below. Obviously, drawings described below are only some examples or embodiments of the present disclosure. Those skilled in the art, without further creative efforts, may apply the present disclosure to other similar scenarios according to these drawings. It should be understood that the exemplary embodiments are provided merely for better comprehension and application of the present disclosure by those skilled in the art, and not intended to limit the scope of the present disclosure. Unless obviously obtained from the context or the context illustrates otherwise, the same numeral in the drawings refers to the same structure or operation.

As used in the disclosure and the appended claims, the singular forms "a," "an," and "the" include plural referents unless the content clearly dictates otherwise. In general, the terms "comprise," "comprises," and/or "comprising," "include," "includes," and/or "including," merely prompt to include steps and elements that have been clearly identified, and these steps and elements do not constitute an exclusive listing. The methods or devices may also include other steps or elements. The term "based on" is "based at least in part on." The term "one embodiment" means "at least one embodiment", and the term "another embodiment" means "at least one additional embodiment". Related definitions of other terms will be given in the description below. Hereinafter, "player", "speaker device", "speaking device" or "speaker" will be used in describing the sound conduction related techniques in the present invention. This description is only a form of speaker application. For those skilled in the art, "speaker device", "speaker", or "earphone" can also be replaced by other similar words, such as "player", "hearing aid", or the like. In fact, the various implementations in the present disclosure may be easily applied to other non-speaker-type hearing devices. For example, for those skilled in the art, after understanding the basic principle of the speaker device, various modifications and changes to the implementation of the speaker device may be performed on the specific methods and details of the speaker device without departing from this principle. In particular, the environment sound picking and processing function may be added to the speaker device, so that the speaker device has the function of the hearing aid. For example, in the case of using a bone conduction speaker device, a sound transmitter such as a microphone may pick up an ambient sound close to the user/wearer. The sound may be further processed using a certain algorithm, and the processed sound (or a generated electrical signal) may be transmitted to the user/wearer. That is, the speaker device may be modified and have the function of picking up ambient sound. The ambient sound may be processed and transmitted to the user/wearer through the speaker device, thereby implementing the function of a hearing aid. The algorithm mentioned above may include a noise cancellation algorithm, an automatic gain control algorithm, an acoustic feedback suppression algorithm, a wide dynamic range compression algorithm, an active environment recognition algorithm, an active noise reduction algorithm, a directional processing algorithm, a tinnitus processing algorithm, a multi-channel wide dynamic range compression algorithm, an active howling suppression algorithm, a volume control algorithm, or the like, or any combination thereof.

FIG. 1 is a flowchart illustrating an exemplary process for generating auditory sense through a speaker device according to some embodiments of the present disclosure. The speaker device may transfer sound to an auditory system through bone conduction or air conduction, thereby generating an auditory sense. As shown in FIG. 1, the process for generating the auditory sense through the speaker device may include the following operations.

In 101, the speaker device may acquire or generate a signal (also referred to as a "sound signal") containing sound information. In some embodiments, the sound information may refer to a video file or an audio file with a specific data format, or data or files that may be converted to a sound through specific approaches. In some embodiments, the signal containing the sound information may be obtained from a storage unit of the speaker device itself. In some embodiments, the signal containing the sound information may be obtained from an information generation system, a storage system, or a transmission system other than the speaker device. The signal containing the sound information may include an electrical signal, and/or other forms of signals other than the electrical signal, such as an optical signal, a magnetic signal, and a mechanical signal, or the like. In principle, as long as the signal includes information that may be used to generate sounds by a speaker device, the signal may be processed as the sound signal. In some embodiments, the sound signal may come from a signal source or a plurality of signal sources. The plurality of signal sources may be independent of or dependent on each other. In some embodiments, manners of generating or transmitting the sound signal may be wired or wireless and may be real-time or time-delayed. For example, the speaker device may receive an electrical signal containing sound information via a wired or wireless connection or may obtain data directly from a storage medium and generate a sound signal. Taking bone conduction technology as an example, components with sound collection function(s) may be added to a bone conduction speaker device. The bone conduction speaker device may pick up sound from the ambient environment and convert a mechanical vibration of the sound into an electrical signal. Further, the electrical signal may be processed through an amplifier to meet specific requirements. The wired connection may be realized by using, including but not limited to a metal cable, an optical cable, or a hybrid cable of metal and optical, such as a coaxial cable, a communication cable, a flexible cable, a spiral cable, a non-metal sheathed cable, a metal sheathed cable, a multi-core cable, a twisted pair cable, a ribbon cable, a shielded cable, a telecommunication cable, a double-stranded cable, a parallel twin-core wire, a twisted-pair wire. The wired connection may also be realized by using other types of transmission carriers, such as transmission carriers for an electrical or optical signal.

The storage device or storage unit mentioned herein may include a storage device or storage unit on a direct attached storage, a network attached storage, a storage area network, and/or other storage systems. The storage device may include but is not limited to common types of storage devices such as a solid-state storage device (a solid-state drive, a solid-state hybrid hard drive, etc.), a mechanical hard drive, a USB flash drive, a memory stick, a storage card (e.g., CF, SD, etc.), and other drives (e.g., CD, DVD, HD DVD, Blu-ray, etc.), a random access memory (RAM), a read-only memory (ROM), etc. The RAM may include but is not limited to a decimal counter, a selection tube, a delay line memory, a Williams tube, a dynamic random access memory (DRAM), a static random access memory (SRAM), a thyristor random access memory (T-RAM), a zero capacitive random access memory (Z-RAM), etc. The ROM may include but is not limited to a magnetic bubble memory, a magnetic button line memory, a thin film memory, a magnetic plating line memory, a magnetic core memory, a drum memory, an optical disk driver, a hard disk, a magnetic tape, an early non-volatile memory (NVRAM), a phase change memory, a magneto-resistive random access memory, a ferroelectric random access memory, a non-volatile SRAM, a flash memory, an electronically erasable rewritable read-only memory, an erasable programmable read-only memory, a programmable read-only memory, a shielded heap read memory, a floating connection gate random access memory, a nano random access memory, a racetrack memory, a variable resistance memory, a programmable metallization unit, etc. The storage device/storage unit mentioned above is only used for illustration purposes. The storage medium used in the storage device/unit is not limited.

In 102, the speaker device may convert the signal containing the sound information into vibration to generate the sound. The speaker device may use a specific transducer to convert the signal into a mechanical vibration, and the generation of the mechanical vibration may accompany with energy conversion. The energy conversion process may include coexistence and conversion of multiple types of energy. For example, the electrical signal may be directly converted into the mechanical vibration by the transducers, and generate the sound. As another example, the sound information may be included in an optical signal, which may be converted into mechanical vibrations by a specific transducer. Other types of energy that may be coexisting and converted when the transducer works may include thermal energy, magnetic field energy, etc. In some embodiments, an energy conversion type of the transducer may include but is not limited to, a moving coil type, an electrostatic type, a piezoelectric type, a moving iron type, a pneumatic type, an electromagnetic type, or the like, or any combination thereof. A frequency response range and sound quality of the speaker device may be affected by the energy conversion type and a property of each physical component of the transducer. For example, in a transducer with the moving coil type, a wound cylindrical coil may be connected to a vibration plate, the coil driven by a signal current may drive the vibration plate to vibrate in a magnetic field and generate the sound. Factors, such as material expansion and contraction, folds deformation, a size, a shape, and a fixation manner of the vibration plate, a magnetic density of a permanent magnet, etc., may have a relatively great effect on the sound quality of the speaker device.

The term "sound quality" used herein may indicate the quality of the sound, which may refer to an audio fidelity after the sound is processed, transmitted, or the like. In an audio device, the sound quality may include audio intensity and magnitude, an audio frequency, an audio overtone, or harmonic components, etc. For an audio device, the sound quality may include audio intensity and magnitude, an audio frequency, an audio overtone, a harmonic component, or the like, or any combination thereof. When the sound quality is evaluated, a measuring manner and an evaluation criterion for objectively evaluating the sound quality may be used, other manners that combine different elements of the sound and subjective feelings for evaluating various properties of the sound quality may also be used.

In 103, the sound is transmitted by a transmission system. In some embodiments, a transmission system refers to a substance that can deliver a vibration signal containing sound information, such as the skull, the bony labyrinth, the inner ear lymph, the spiral organ of a human or/and an animal with the auditory system. As another example, the transmission system also refers to a medium (e.g., air and liquid) that may transmit a sound. To illustrate the process of transmitting sound information by the transmission system, a bone conduction speaker device may be taken as an example. The bone conduction speaker device may directly transmit a sound wave (e.g., a vibration signal) converted from an electrical signal to an auditory center through bones. In addition, the sound wave may be transmitted to the auditory center through air conduction. More descriptions regarding the air conduction may be found elsewhere in the present disclosure.

In 104, the sound information may be transmitted to a sensing terminal. Specifically, the sound information may be transmitted to the sensing terminal through the transmission system. In some embodiments, the speaker device may pick up or generate a signal containing the sound information, convert the sound information into a sound vibration by the transducer. The speaker device may transmit the sound to the sensing terminal through the transmission system, and a user may hear the sound. Generally, a subject of the sensing terminal, the auditory system, the sensory organ, etc. described above may be a human or an animal with the auditory system. It should be noted that the following description of the speaker device used by a human does not constitute a restriction on the application scene of the speaker device, and similar descriptions may also be applied to other animals.

The above description of the process of the speaker device is only a specific example and should be not regarded as the only feasible implementation. Obviously, for those skilled in the art, after understanding the basic principle of the speaker device, it may be possible to make various modifications and changes in forms and details of the specific methods and operations of implementing the speaker device without departing from the principles, but these modifications and changes are still within the scope of the present disclosure.

Figure 2:
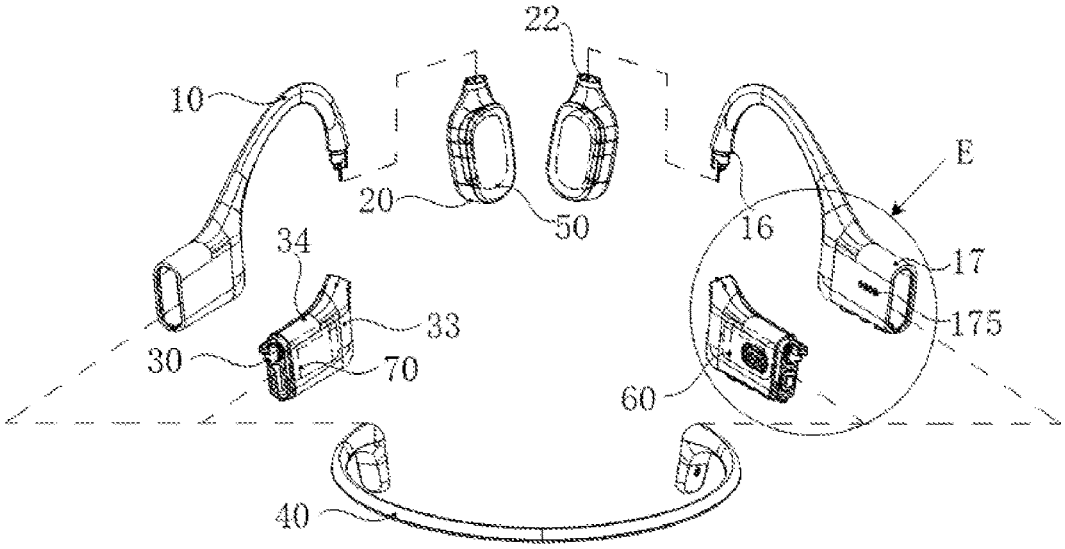
FIG. 2 is a schematic diagram illustrating an exploded structure of an exemplary MP3 player according to some embodiments of the present disclosure.

The speaker device described according to some embodiments of the present disclosure may include, but is not limited to, an earphone, an MP3 player, a hearing aid, or other devices with speaker function. In the following specific embodiments of the present disclosure, an MP3 player is taken as an example to describe the speaker device in detail. FIG. 2 is a schematic diagram illustrating an exploded structure of an exemplary MP3 player according to some embodiments of the present disclosure. As shown in FIG. 2, in some embodiments, an MP3 player may include an ear hook 10, a core housing 20, a circuit housing 30, a rear hook 40, an earphone core 50, a control circuit 60, and a battery 70. The core housing 20 and the circuit housing 30 may be disposed at two ends of the ear hook 10 respectively, and the rear hook 40 may be further disposed at an end of the circuit housing 30 away from the ear hook 10. The number (or the count) of the core housings 20 may be two. The two core housings 20 may be configured to accommodate two earphone cores 50, respectively. The number (or the count) of the circuit housings 30 may be two. The two circuit housings 30 may be configured to accommodate the control circuit 60 and the battery 70, respectively. In some embodiments, the control circuit 60 may be configured to cause the earphone core 50 to vibrate to generate a sound. For example, the control circuit 60 may cause the earphone core 50 to vibrate based on a control signal which may be generated when a user presses a button of the MP3 player.

Figure 3:
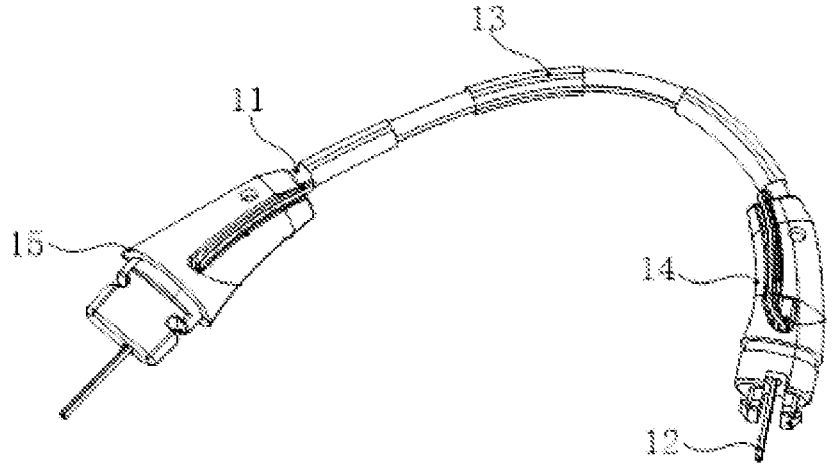
FIG. 3 is a schematic diagram illustrating a part of a structure of an ear hook of an MP3 player according to some embodiments of the present disclosure.
Figure 4:
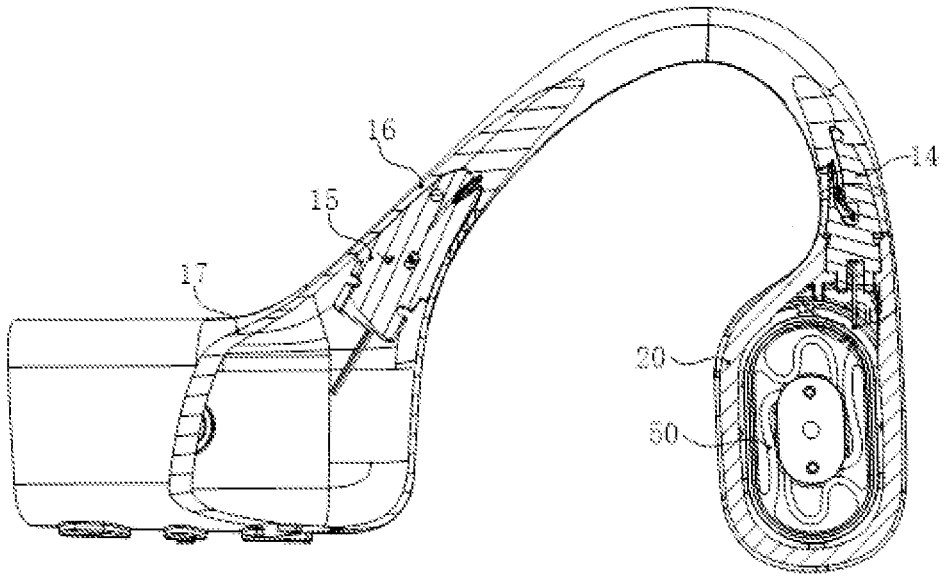
FIG. 4 is a partial sectional view of an MP3 player according to some embodiments of the present disclosure.

FIG. 3 is a schematic diagram illustrating a part of a structure of an ear hook of an MP3 player according to some embodiments of the present disclosure. FIG. 4 is a partial sectional view of an MP3 player according to some embodiments of the present disclosure. Referring to FIG. 2, FIG. 3, and FIG. 4, in some embodiments, the ear hook 10 may include an elastic metal wire 11, a wire 12, a fixing sleeve 13, a first plug end 14, and a second plug end 15. The first plug end 14 and the second plug end 15 may be disposed at both ends of the elastic metal wire 11. In some embodiments, the ear hook 10 may further include a protective sleeve 16 and a housing sheath 17 integrally formed with the protective sleeve 16. In some embodiments, the protective sleeve 16 may be injection moulded around a periphery of the elastic metal wire 11, the wire 12, the fixing sleeve 13, the first plug end 14, and the second plug end 15. Thus, the protective sleeve 16 may be fixedly connected with the elastic metal wire 11, the wire 12, the fixing sleeve 13, the first plug end 14, and the second plug end 15 respectively. There is no need to form the protective sleeve 16 separately by injection molding and then further wrap protective sleeve 16 around the periphery of the elastic metal wire 11, the first plug end 14, and the second plug end 15, thereby simplifying the manufacturing and assembly processes and improving the reliability and stability of the fixation of the protective sleeve 16.

In some embodiments, when the protective sleeve 16 is being formed, a housing sheath 17 disposed on a side close to the second plug end 15 may be integrally formed with the protective sleeve 16. In some embodiments, the housing sheath 17 may be integrally formed with the protective sleeve 16 to form a whole structure. The circuit housing 30 may be connected to one end of the ear hook 10 by being plugged and fixed to the second plug end 15. A socket 22 of the core housing 20 may be connected to the other end of the ear hook 10 by being fixed to the first plug end 14. The housing sheath 17 may be moulded on the ear hook 10. The housing sheath 17 may be further wrapped around the periphery of the circuit housing 30 in a sleeved manner. In some embodiments, the protective sleeve 16 and the housing sheath 17 may include soft material with certain elasticity, such as silica gel, rubber, or the like, or any combination thereof. In some embodiments, the housing sheath 17 may have a bag-like structure with an opening end, and the circuit housing 30 may enter an inside of the housing sheath 17 through the opening end of the housing sheath 17. The opening of the housing sheath 17 may be disposed on an end of the housing sheath 17 away from the protective sleeve 16, and the circuit housing 30 may enter the inside of the housing sheath 17 from the end of the housing sheath 17 away from the protective sleeve 16 and be covered by the housing sheath 17.

Figure 5:
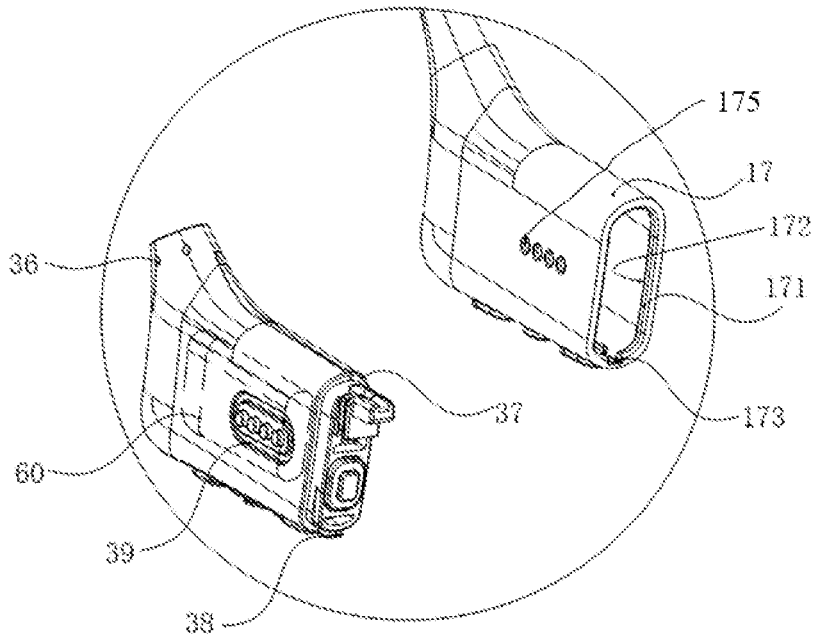
FIG. 5 is a schematic diagram illustrating a partial enlarged view of part E in FIG. 2.

FIG. 5 is a schematic diagram illustrating a partial enlarged view of part E in FIG. 2. Referring to FIG. 2 and FIG. 5, in some embodiments, an opening end of the housing sheath 17 may include an annular flange 171 protruding inwardly. The end of the circuit housing 30 away from the ear hook 10 may have a stepped structure, so as to form an annular table 37. The annular flange 171 may abut on the annular table 37 when the housing sheath 17 covers the periphery of the circuit housing 30. The annular flange 171 may be formed by an inner wall surface of the opening end of the housing sheath 17 protruding to a certain thickness toward the inside of the housing sheath 17. The annular flange 171 may include a flange surface 172 facing the ear hook 10. The annular table 37 may be opposite to the flange surface 172 and toward a direction of the circuit housing 30 away from the ear hook 10. A height of the flange surface 172 of the annular flange 171 may be not greater than a height of the annular table 37, the inner wall surface of the housing sheath 17 may abut the sidewall of the circuit housing 30, and the housing sheath 17 may tightly cover the periphery of the circuit housing 30 when the flange surface 172 of the annular flange 171 abuts the annular table 37. In some embodiments, a sealant may be applied to a joint area between the annular flange 171 and the annular table 37. Specifically, when the housing sheath 17 is used to cover the circuit housing 30, the sealant may be coated on the annular table 37 to seal the housing sheath 17 and the circuit housing 30.

In some embodiments, the circuit housing 30 may include a positioning block 38. The positioning block 38 may be disposed on the annular table 37 and extend along a direction of the circuit housing 30 away from the ear hook 10. Specifically, the positioning block 38 may be disposed on the auxiliary sidewall 34 of the circuit housing 30, and a thickness of the positioning block 38 protruding on the auxiliary sidewall 34 may be consistent with a height of the annular table 37. The number of the positioning blocks 38 may be one or more, which can be set according to an actual requirement. Correspondingly, the annular flange 171 of the housing sheath 17 may include a positioning groove 173 corresponding to the positioning block 38, and the positioning groove 173 may cover at least a portion of the positioning block 38 when the housing sheath 17 covers the periphery of the circuit housing 30.

Figure 6:
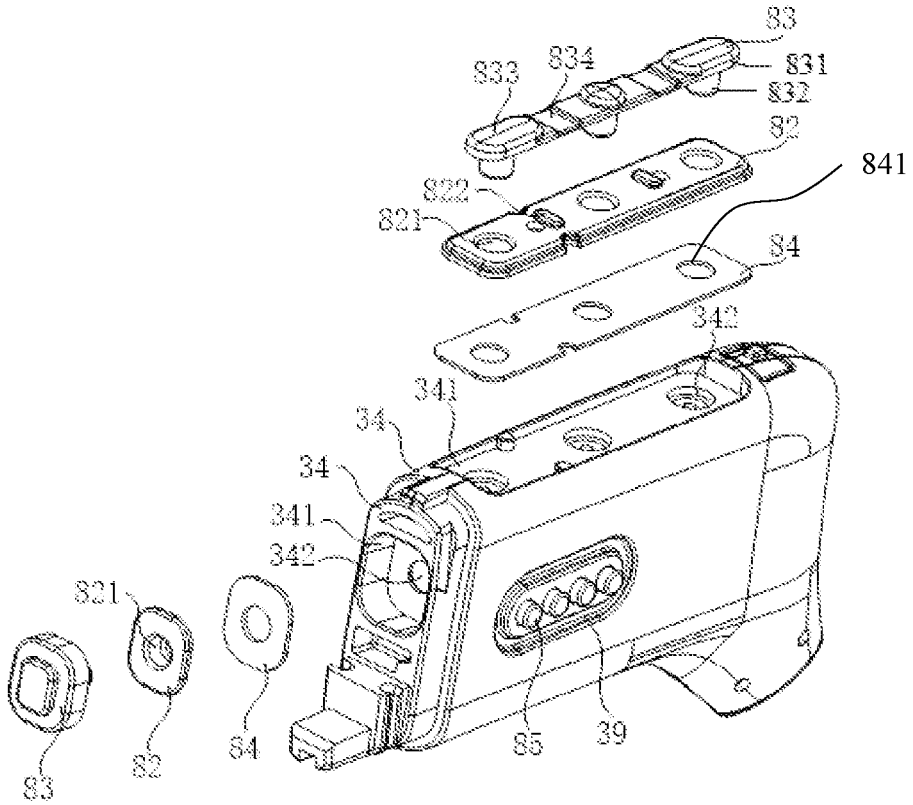
FIG. 6 is a schematic diagram illustrating an exploded view of partial structures of an exemplary circuit housing and an exemplary button mechanism according to some embodiments of the present disclosure.
Figure 7:
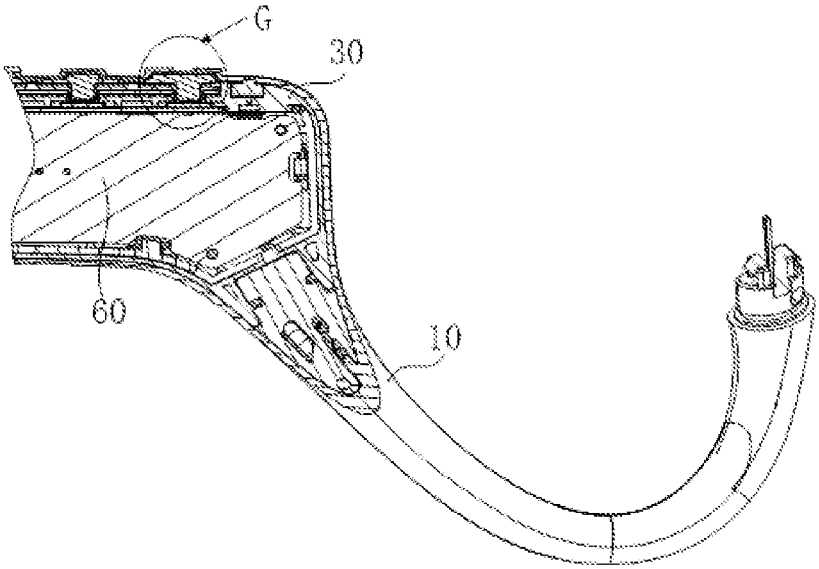
FIG. 7 is a schematic diagram illustrating cross-sectional views of partial structures of an exemplary circuit housing, an exemplary button mechanism, and an exemplary ear hook according to some embodiments of the present disclosure.
Figure 8:
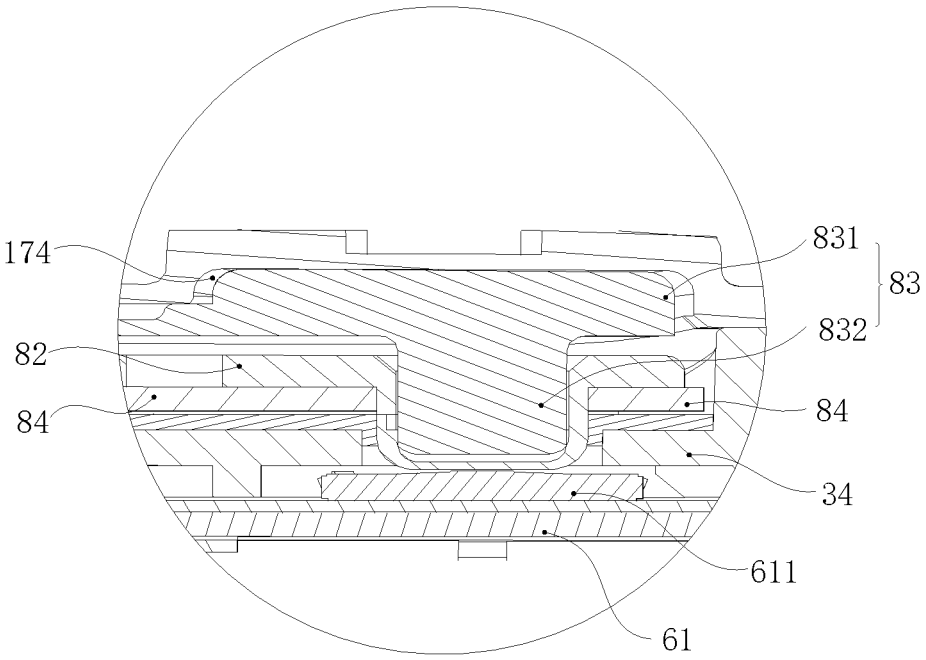
FIG. 8 is a schematic diagram illustrating a partial enlarged view of part G in FIG. 7.

FIG. 6 is a schematic diagram illustrating an exploded view of partial structures of an exemplary circuit housing and an exemplary button mechanism according to some embodiments of the present disclosure. FIG. 7 is a schematic diagram illustrating cross-sectional views of partial structures of an exemplary circuit housing, an exemplary button mechanism, and an exemplary ear hook according to some embodiments of the present disclosure. FIG. 8 is a schematic diagram illustrating a partial enlarged view of part G in FIG. 7. Referring to FIG. 2, FIG. 6, FIG. 7, and FIG. 8, in some embodiments, an MP3 player may include a button mechanism (e.g., a button 83). In this embodiment, two opposite sidewalls of the circuit housing 30 with a relatively large area may be main sidewalls 33, and two opposite sidewalls with a relatively small area connecting the two main sidewalls 33 may be auxiliary sidewalls 34. A first recessed area 341 may be disposed on an outer surface of the auxiliary sidewalls 34 of the circuit housing 30, and the first recessed area 341 may include a button hole 342 connecting the outer surface and an inner surface of the auxiliary sidewalls 34. The auxiliary sidewalls 34 of the circuit housing 30 may include an auxiliary sidewall facing toward a rear side of a user's head when the user wears the MP3 player, and may also include an auxiliary sidewall facing toward a lower side of the user's head when the user wears the MP3 player. The number (or count) of the first recessed areas 341 may be one or more, and each of the first recessed areas 341 may include one or more button holes 342. The count of the button holes 342 may be set according to actual needs, which is not specifically limited herein.

In some embodiments, the MP3 player may further include an elastic pad 82. The elastic pad 82 may be disposed in the first recessed area 341 and may be specifically fixed on an outer surface of the auxiliary sidewall 34 corresponding to the first recessed area 341, so as to cover a periphery of the button hole 342, and prevent external liquid from entering into the inside of the circuit housing 30 through the button hole 342, thereby improving sealing and waterproofing performance of the MP3 player. In some embodiments, the elastic pad 82 may include a second recessed area 821 corresponding to the button hole 342, and the second recessed area 821 may extend to an inside of the button hole 342. In some embodiments, the elastic pad 82 may be made of soft material, such as soft silicone, rubber, or the like, or any combination thereof. In addition, the elastic pad 82 may be relatively thin, which makes it difficult to bond the elastic pad 82 firmly to the outer surface of the auxiliary sidewall 34 when the elastic pad 82 is directly bonded to the outer surface of the auxiliary sidewall 34.

In some embodiments, a rigid pad 84 may be disposed between the elastic pad 82 and the circuit housing 30. The rigid pad 84 and the elastic pad 82 may be fixed against each other, e.g., in a lamination manner, a bonding manner, an injection molding manner, etc. Further, the rigid pad 84 may be bonded to the auxiliary sidewall 34, e.g., by using a double-sided adhesive, so as to form an adhesive layer between the rigid pad 84 and the auxiliary sidewall 34. In this case, the elastic pad 82 may be firmly fixed on the outer surface of the auxiliary sidewall 34. In addition, since the elastic pad 82 is soft and thin, it may be difficult for the elastic pad 82 to maintain a flat state when a user presses the button. By fixing the rigid pad 84, the elastic pad 82 may maintain flat.

In some embodiments, the rigid pad 84 may include a through hole 841 that allows the second recessed area 821 to pass through, such that the second recessed area 821 of the elastic pad 82 may further extend to the button hole 342 through the through hole 841. In some embodiments, the rigid pad 84 may include stainless steel, or other steel materials, such as a hard material (e.g., plastic material, etc.). The rigid pad 84 may be integrally formed to abut against the elastic pad 82.

In some embodiments, the button 83 may include a button body 831 and a button contact 832 protruding from one side of the button body 831. The button body 831 may be disposed on a side of the elastic pad 82 away from the circuit housing 30, and the button contact 832 may extend into the second recessed area 821 to extend into the button hole 342 along with the second recessed area 821. Since the MP3 player in this embodiment is relatively thin and/or light, a pressing stroke of the button 83 may be short. If a soft button is used, the user's pressing feeling may be affected, and bring a bad experience for the user. In some embodiments, the button 83 may include hard plastic material, such that the user may have a good feel when pressing the button 83.

In some embodiments, a control circuit 60 may include a button circuit board 61. The button circuit board 61 may be placed inside the circuit housing 30. The button circuit board 61 may include a button switch 611 corresponding to the button hole 342. Thus, when the user presses the button 83, the button contact 832 may contact and trigger the button switch 611 to implement a corresponding function.

In some embodiments, a second recessed area 821 may be disposed on the elastic pad 82. In this case, on the one hand, the second recessed area 821 may cover the button hole 342, which may improve the waterproof effect of the MP3 player. On the other hand, in a natural state, the button contact 832 may extend into the button hole 342 through the second recessed area 821, which may shorten the pressing stroke of the button to reduce a space occupied by the button mechanism. Thus, the MP3 player may not only have good waterproof performance, but also take up less space.

In some embodiments, the button 83 may include a button unit 833, and the count (or number) of the button unit 833 may be one or more. In an application scenario, the button 83 may include at least two button units 833 spaced from each other and a connection part 834 configured to connect the button units 833. The button units 833 may be integrated with the connection part 834. Each button unit 833 may correspond to a button contact 832, and further correspond to a button hole 342 and a button switch 611. Each first recessed area 341 may include a plurality of button units 833, and the user may trigger different button switches 611 by pressing different button units 833, and realize multiple functions.

In some embodiments, the elastic pad 82 may include an elastic convex 822 for supporting the connection part 834. Since the button 83 may include the plurality of button units 833 connected to each other, the elastic convex 822 may cause one of the button unit 833 to be pressed separately when the user presses the corresponding button unit 833, thereby avoiding that other button units 833 are pressed due to a linkage between the plurality of button units 833. In this case, the corresponding button switch 611 may be triggered accurately. It should be noted that the elastic convex 822 is not necessary. For example, the elastic convex 822 may be a protruding structure without elasticity, or the protruding structure may be removed. The elastic convex 822 may be set according to an actual condition. In some embodiments, the inner wall of the housing sheath 17 may include a concave 174 corresponding to the button 83, such that the periphery of the circuit housing 30 and the button 83 may be covered in a sleeved manner.

Figure 9:
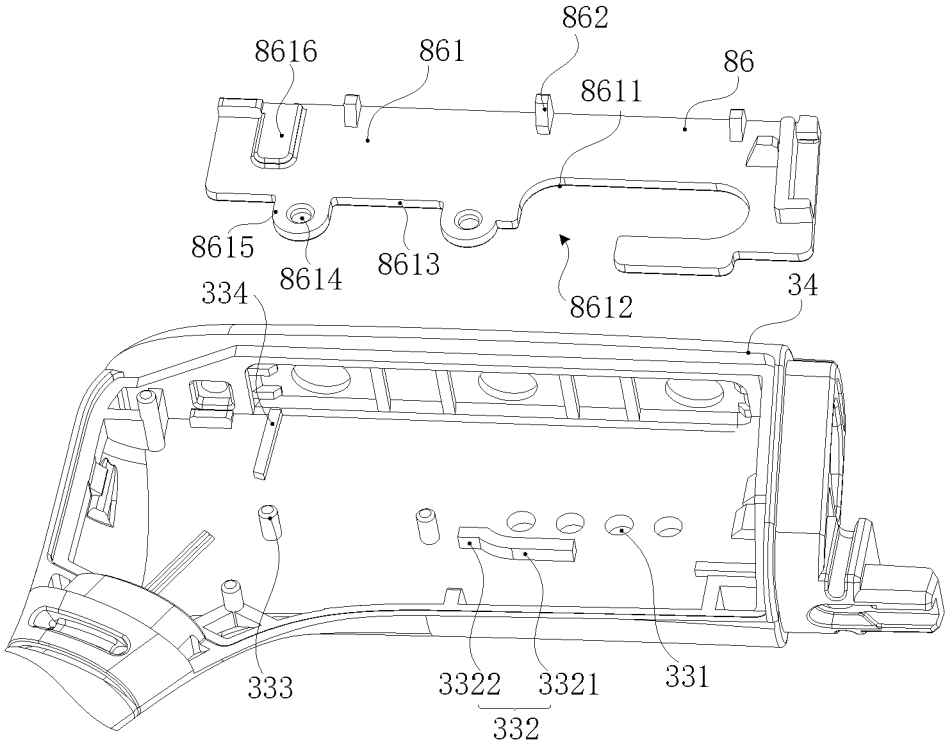
FIG. 9 is a schematic diagram illustrating an exploded view of partial structures of an exemplary circuit housing and an exemplary auxiliary film according to some embodiments of the present disclosure.
Figure 10:
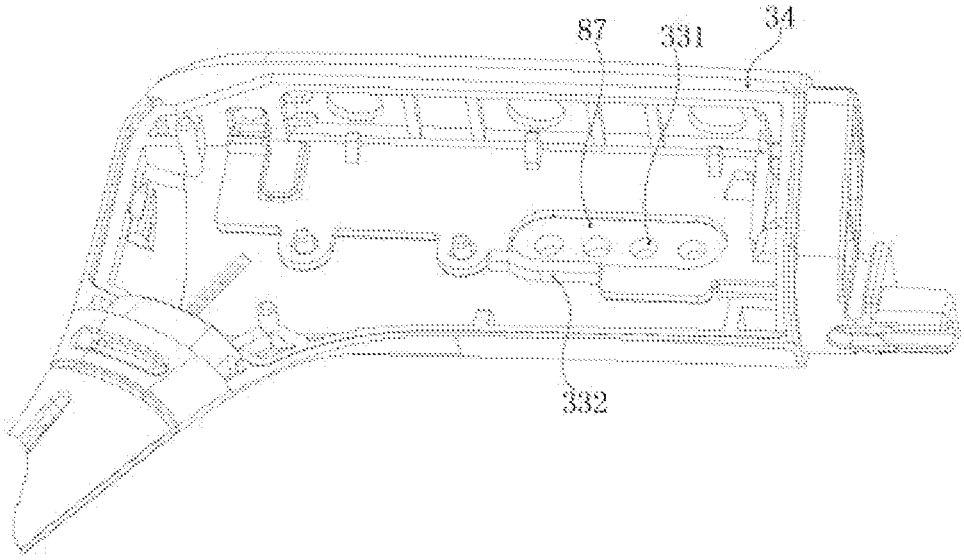
FIG. 10 is a schematic diagram illustrating partial structures of an exemplary circuit housing and an exemplary auxiliary film according to some embodiments of the present disclosure.

FIG. 9 is a schematic diagram illustrating an exploded view of partial structures of an exemplary circuit housing and an exemplary auxiliary film according to some embodiments of the present disclosure. FIG. 10 is a schematic diagram illustrating partial structures of an exemplary circuit housing and an exemplary auxiliary film according to some embodiments of the present disclosure. Referring to FIG. 2, FIG. 9, and FIG. 10, in some embodiments, an MP3 player may include an auxiliary film 86 located inside the circuit housing 30. The auxiliary film 86 may include a board 861. The board 861 may include a hollow region 8611. The board 861 may be disposed on an inner surface of the main sidewall 33 by means of hot melting or hot pressing, bonding, etc. The mounting hole 331 on the main sidewall 33 may be located inside the hollow region 8611. Specifically, a board surface of the board 861 may abut against the inner surface of the main sidewall 33 in parallel. The auxiliary film 86 may have a certain thickness. After the auxiliary film 86 is placed on the inner surface of the main sidewall 33, an inner sidewall of the hollow region 8611 of the auxiliary film 86 and the main sidewall 33 may form a glue tank 87 located on a periphery of a conductive post 85 inserted in the mounting hole 331.

In some embodiments, a sealant may be applied in the glue tank 87, such that the mounting hole 331 may be sealed from the inside of circuit housing 30 to improve the tightness of the circuit housing 30, thereby improving the waterproof performance of the MP3 player.

In some embodiments, a material of the auxiliary film 86 may be the same as that of the circuit housing 30. In some embodiments, the auxiliary film 86 and the circuit housing 30 may be separately formed. It should be noted that, during a molding stage of the circuit housing 30, there may be other structures near the mounting hole 331, such as the button hole 342 to be moulded, etc. Molds corresponding to these structures during molding may need to be withdrawn from the inside of the circuit housing 30. At this time, if the glue tank 87 corresponding to the mounting hole 331 is integrated directly inside the circuit housing 30, a convex of the glue tank 87 may hinder a smooth withdrawal of the molds corresponding to these structures, thereby causing inconvenience to the production of the MP3 player. In this embodiment, the auxiliary film 86 and the circuit housing 30 may be independent structures. After forming the two structures separately, the auxiliary film 86 may be installed inside the circuit housing 30 to form the glue tank 87 together with the main sidewall 33 of the circuit housing 30. In this way, during the molding stage of the circuit housing 30, the molds of a portion of the structures may be not hindered from withdrawing from the inside of the circuit housing 30, which may be beneficial to smooth production.

In some embodiments, when molding the circuit housing 30, the withdrawal of the molds may only take up part of the space occupied by the glue tank 87. Without affecting the withdrawal of the molds, a part of the glue tank 87 may be integrated on the inner surface of the main sidewall 33, and the other parts of the glue tank 87 may still be formed by the auxiliary film 86.

In some embodiments, the inner surface of the main sidewall 33 may be integrated with a first striped convex rib 332. A position of the first striped convex rib 332 may not affect the withdrawal of the mold of the circuit housing 30. The hollow region 8611 of the auxiliary film 86 may include a notch 8612. The first striped convex rib 332 may correspond to the notch 8612. After the circuit housing 30 and the auxiliary film 86 are formed respectively, the auxiliary film 86 may be placed on the inner surface of the main sidewall 33, such that the first striped convex rib 332 may be at least partially fitted to the notch 8612. The first striped convex rib 332 and the auxiliary film 86 may be combined to make the glue tank 87 closed.

In this embodiment, since the first striped convex rib 332 does not hinder the withdrawal of the mold, a sidewall of the glue tank 87 may be formed by the first striped convex rib 332 and auxiliary film 86. The first striped convex rib 332 may be integrally formed on the inner surface of the main sidewall 33.

In some embodiments, the first striped convex rib 332 may further extend to abut against a side edge 8613 of the board 861, thereby positioning the board 861. The first striped convex rib 332 may include a rib body 3321 and an arm 3322. The rib body 3321 may be configured to match and fit with the notch 8612 of the hollow region 8611, thereby forming a sidewall of the glue tank 87. The arm 3322 may be formed by a further extension of one end of the rib body 3321, and may extend to a side edge 8613 of the board 861 to abut against the side edge 8613, such that the board 861 may be positioned at the side edge 8613.

In some embodiments, a protrusion height of the first striped convex rib 332 on the inner surface of the main sidewall 33 may be greater than, smaller than, or equal to a thickness of the auxiliary film 86, as long as the first striped convex rib 332 and the auxiliary film 86 may form the glue tank 87, and position the board 861 of the auxiliary film 86. The protrusion height of the first striped convex rib 332 is not limited herein.

In some embodiments, the board 861 may include a positioning hole 8614, and the positioning hole 8614 may penetrate through a main board surface of the board 861. The inner surface of the main sidewall 33 may be integrated with the positioning post 333 corresponding to the positioning hole 8614. After the auxiliary film 86 is placed on the inner surface of the main sidewall 33, the positioning post 333 may be inserted into the positioning hole 8614, thereby further positioning the auxiliary film 86. The number (or count) of the positioning holes 8614 may be equal to the count of the positioning posts 333. In this embodiment, the number (or the count) of the positioning holes 8614 or that of the positioning posts 333 may be two.

In an application scenario, at least two lugs 8615 may be formed on a side edge 8613 of the board 861, and two holes 8614 may be placed on corresponding lugs 8615, respectively. The inner surface of the main sidewall 33 may be integrated with a second striped convex rib 334. The second striped convex rib 334 may extend in a direction toward the auxiliary sidewall 34, and may be perpendicular to an extending direction of the arm 3322 of the first striped convex rib 332. The board 861 may also include a bar-shaped positioning groove 8616 corresponding to the second striped convex rib 334. The positioning groove 8616 may be recessed along a direction away from the main sidewall 33, and one end of the positioning groove 8616 may be connected to the side edge 8613 of the board 861 and may be perpendicular to the side edge 8613.

In an application scenario, the positioning groove 8616 may be formed by a recession of a surface of the board 861 that abuts against the main sidewall 33. A depth of the positioning groove 8616 may be less than the thickness of the board 861. In this case, a surface of the board 861 opposite to the recessed surface of the board 861 may be not affected by the positioning groove 8616. In another application scenario, the depth of the positioning groove 8616 may be greater than a thickness of the board 861, such that when a surface of the board 861 close to the main sidewall 33 is recessed, the other opposite surface of the board 861 may protrude toward a recessed direction, thereby forming the positioning groove 8616. After the auxiliary film 86 is placed on the inner surface of the main sidewall 33, the second striped convex rib 334 may be embedded in the positioning groove 8616 to further position the board 861.

Referring to FIG. 2, FIG. 5, and FIG. 6, in some embodiments, the housing sheath 17 may include an exposed hole 175 corresponding to the conductive post 85. After the housing sheath 17 is sleeved over the periphery of the circuit housing 30, one end of the conductive post 85 located outside the circuit housing 30 may be exposed through the exposed hole 175, and then connected to an external circuit of the MP3 player, such that the MP3 player may receive power supply or perform data transmission through the conductive post 85.

In some embodiments, the outer surface of the circuit housing 30 may be recessed with a glue tank 39 surrounding a plurality of mounting holes 331. Specifically, a shape of the glue tank 39 may include an oval ring. The plurality of mounting holes 331 may be respectively disposed on the circuit housing 30 surrounded by the glue tank 39 with the shape of oval ring. A sealant may be applied to the glue tank 39. After the housing sheath 17 and the circuit housing 30 are assembled, the housing sheath 17 may be connected to the circuit housing 30 on a periphery of the mounting hole 331 via the sealant. In this way, when external liquid enters the inside of the housing sheath 17 through the exposed hole 175, the housing sheath 17 may be protected from sliding around the periphery of the circuit housing 30, and the mounting hole 331 may be further sealed from the outside of the circuit housing 30, which may further improve the tightness of the circuit housing 30 and improve the waterproof performance of the MP3 player.

It should be noted that the above descriptions of the MP3 player are only specific examples and should be not regarded as the only feasible implementation solution. Obviously, for those skilled in the art, after understanding the basic principles of the MP3 player, various modifications and changes in forms and details of the specific methods and steps for implementing the MP3 player may be made without departing from the principles. For example, the number of the first recessed area(s) (e.g., the first recessed area 341) may be multiple, and each of the first recessed areas may include one or more button holes, which are not limited herein. Such modifications, changes, and variations are all within the protection scope of the present disclosure.

Figure 11:
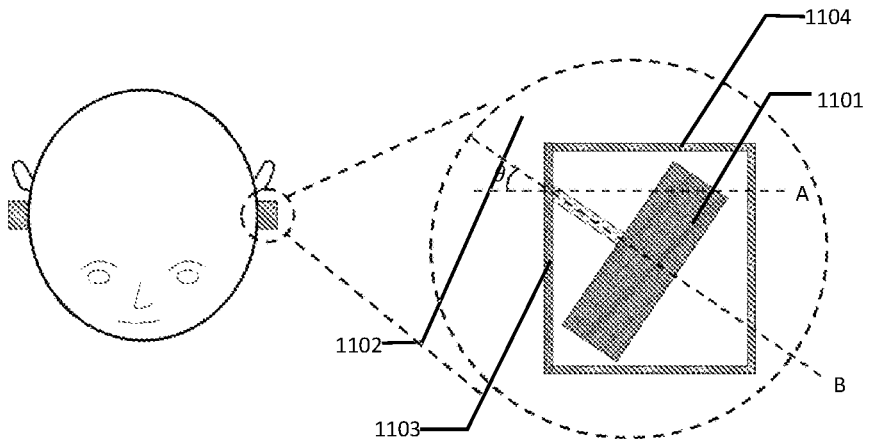
FIG. 11 is a schematic diagram illustrating an application scenario and a structure of an exemplary speaker device according to some embodiments of the present disclosure.

FIG. 11 is a schematic diagram illustrating an application scenario and a structure of an exemplary speaker device according to some embodiments of the present disclosure. As shown in FIG. 11 and FIG. 2, in some embodiments, a housing 1104 in FIG. 11 may be equivalent to the core housing 20 in FIG. 2, and a driving device 1101 in FIG. 11 may be equivalent to the earphone core 50 in FIG. 2. In the following, a bone conduction speaker device may be taken as an example to describe the application scenario and the structure of the speaker device. In some embodiments, as shown in FIG. 11, a speaker device 1100 may include a driving device 1101, a transmission assembly 1102, a panel 1103 (also referred to as a housing panel, which is a side of the core housing 20 facing a user), and a housing 1104. In some embodiments, the housing 1104 may include a housing back and a housing side, and the housing back may be connected to the panel 1103 through the housing side. In some embodiments, the panel 1103 may be connected to the driving device 1101 (e.g., the earphone core) in a transmission connection manner. Specifically, the driving device 1101 may transmit a vibration signal to the panel 1103 and/or the housing 1104 through the transmission assembly 1102, so as to transmit a sound to the human body of a user through the contact between the panel 1103 or the housing 1104 and the human skin. In some embodiments, the panel 1103 and/or the housing 1104 of the bone conduction speaker device may be in contact with the human skin at the tragus, so as to transmit the sound to the human body. In some embodiments, the panel 1103 and/or the housing 1104 may be in contact with human skin on a back side of the auricle. In some embodiments, the driving device 1101 may cause the panel 1103 and/or the housing back to vibrate. More descriptions regarding the vibration of the panel 1103 and the housing back may be found elsewhere in the present disclosure. See, e.g., FIG. 20 and the relevant descriptions thereof.

In some embodiments, a line B (or a vibration direction of the driving device 1101) where a driving force generated by the driving device 1101 locates may form an angle θ with a normal line A of the panel 1103, that is, the line B and the normal line A of the panel 1103 may be not parallel.

The panel 1103 may include an area, and the area may be in contact with or abut against the human body (e.g., the human skin). In some embodiments, the panel 1103 may be covered with other materials (e.g., a soft material such as silicone), thereby improving the wearing comfortability of the human body. In this case, the panel 1103 may be not in direct contact with the human body but abut against the human body. In some embodiments, the entire or a portion of the panel 1103 may be in contact with the human body when the human body wears the bone conduction speaker device. In some embodiments, the area which is in contact with or abuts against the human body may account for more than 50% of the area of the panel 1103. In some embodiments, the area which is in contact with or abuts against the human body may account for more than 60% of the area of the panel 1103. In some embodiments, the area which may be in contact with or abut against the human body may include a flat surface, a curved surface, or the like, or any combination thereof.

In some embodiments, when the area on the panel 1103, which is in contact with or abuts against the human body, is a flat surface, the normal line of the panel 1103 may be a dashed line perpendicular to the flat surface. In some embodiments, when the area on the panel 1103, which is in contact with or abuts against the human body, is a curved surface, the normal line of the panel 1103 may be an average normal line of the curved surface. The average normal line may be represented by Equation (1) below:

$$\hat{r}_0 = \frac{\oiint_S \hat{r} ds}{\left|\oiint_S \hat{r} ds\right|}, \tag{1}$$

where $\hat{r}_0$ represents an average normal line, $\hat{r}$ represents a normal line of a point on the curved surface, and ds represents a surface element.

In some embodiments, the curved surface may include a quasi-plane, which may be close to a plane, that is, an angle between a normal line of a point in at least 50% of the area of the curved surface, and the average normal line may be less than an angle threshold. In some embodiments, the angle threshold may be less than 10°. In some embodiments, the angle threshold may be less than 5°.

In some embodiments, the line B where the driving force locates and the normal line A' of the area on the panel 1103, which is in contact with the human body, may form an angle θ. In some embodiments, a value of the angle θ may be between 0° and 180°. In some embodiments, the value of the angle θ may be between 0° and 180° and not equal to 90°. In some embodiments, assuming that the line B has a positive direction pointing out of the speaker device, and the normal line A of the panel 1103 (or the normal line A' of the area of the panel 1103, which is in contact with the human skin) also has a positive direction pointing out of the speaker device, the angle θ formed between the normal line A and the line B or between the normal line A' and the line B may be an acute angle along the positive directions, that is, the angle θ may be between 0° and 90°. More descriptions regarding the normal line A or the normal line A' may be found elsewhere in the present disclosure. See, e.g., FIG. 13 and the relevant descriptions thereof.

Figure 12:
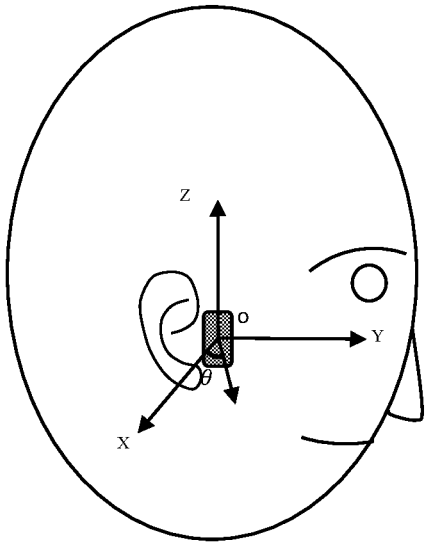
FIG. 12 is a schematic diagram illustrating an exemplary angle direction according to some embodiments of the present disclosure.

FIG. 12 is a schematic diagram illustrating an exemplary angle direction according to some embodiments of the present disclosure. As shown in FIG. 12, in some embodiments, a driving force generated by a driving device (e.g., the driving device 1101) may have a first component in a first quadrant of an XOY plane coordinate system and/or a second component in a third quadrant of the XOY plane coordinate system. In some embodiments, the XOY plane coordinate system may include a reference coordinate system. An origin O of the XOY plane coordinate system may be located on a contact surface between a panel and/or a housing of a speaker device and the human body of a user who wears the speaker device. An X-axis of the XOY plane coordinate system may be parallel to a coronal axis of the human body. A Y-axis of the XOY plane coordinate system may be parallel to a sagittal axis of the human body. A positive direction of the X-axis may face outside of the human body, and a positive direction of the Y-axis may face the front of the human body. Quadrants refer to four regions divided by a horizontal axis (e.g., the X-axis of the XOY plane) and a vertical axis (e.g., the Y-axis of the XOY plane) in a rectangular coordinate system. Each of the four regions is called a quadrant. The quadrant may be centered at an origin, and the horizontal axis and the vertical axis may be regarded as dividing lines between the four regions. A relatively upper right region of the four regions (i.e., a region enclosed by a positive half axis of the horizontal axis and a positive half axis of the vertical axis) of the four regions may be regarded as a first quadrant. A relatively upper left region of the four regions (e.g., a region enclosed by a negative half axis of the horizontal axis and a positive half axis of the vertical axis) of the four regions may be regarded as a second quadrant. A relatively low left region (i.e., a region enclosed by the negative half axis of the horizontal axis and a negative half axis of the vertical axis) of the four regions may be regarded as a third quadrant. A relatively low right region (i.e., a region enclosed by the positive half axis of the horizontal axis and the negative half axis of the vertical axis) of the four regions may be regarded as a fourth quadrant. Each of points at a coordinate axis (e.g., the horizontal axis or the vertical axis) does not belong to any quadrant. It should be understood that a driving force in some embodiments may be located in the first quadrant and/or the third quadrant of the XOY plane coordinate system, or the driving force may be directed in other directions, a projection or a component of the driving force may be in the first quadrant and/or the third quadrant of the XOY plane coordinate system, and a projection or a component of the driving force in a Z-axis direction may be zero or not zero, wherein the Z-axis may be perpendicular to the XOY plane and pass through the origin O. In some embodiments, a relatively small angle θ between a line where the driving force locates and a normal line of an area of a panel of the speaker device, which is in contact with or abuts against the human body of the user may be any acute angle. For example, a range of the angle θ may be 5°~80°. In some embodiments, the range of the angle θ may be 15°~70°. In some embodiments, the range of the angle θ may be 25°~60°. In some embodiments, the range of the angle θ may be 25°~50°. In some embodiments, the range of the angle θ may be 28°~50°. In some embodiments, the range of the angle θ may be 30~39°. In some embodiments, the range of the angle θ may be 31°~38°. In some embodiments, the range of the angle θ may be 32°~37°. In some embodiments, the range of the angle θ may be 33°~36°. In some embodiments, the range of the angle θ may be 33°~35.8°. In some embodiments, the range of the angle θ may be 33.5°~35°. In some embodiments, the angle θ may be 26°, 27°, 28°, 29°, 30°, 31°, 32°, 33°, 34°, 34.2°, 35°, 35.8°, 36°, 37°, 38°, etc., and an error of the angle θ may be controlled within 0.2°. It should be noted that the driving force described above should be not regarded as a limitation of the driving force in the present disclosure. In some embodiments, the driving force may have one or more components in the second and/or the fourth quadrants of the XOY plane coordinate system. In some embodiments, the driving force may be located on the Y-axis.

Figure 13:
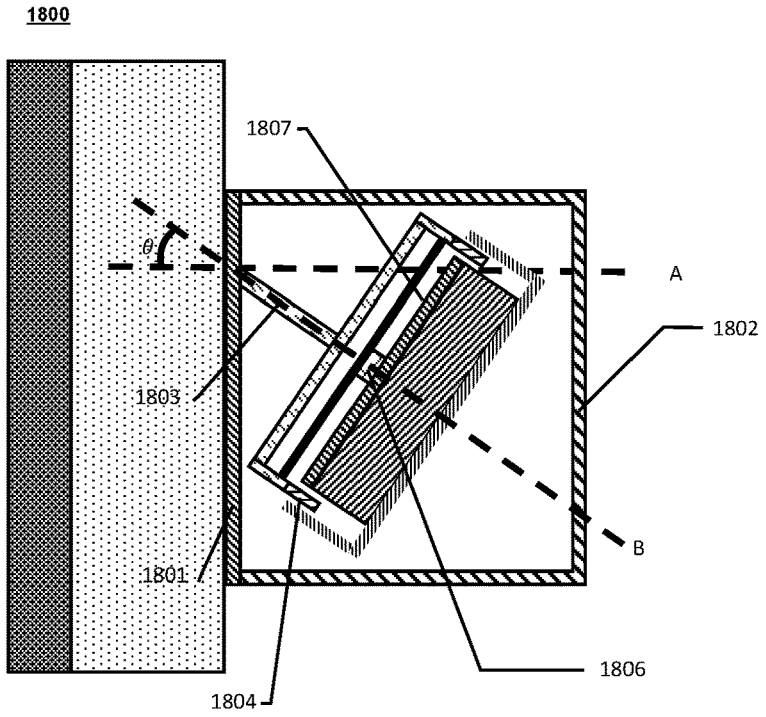
FIG. 13 is a schematic diagram illustrating an exemplary speaker device acting on human skin or bones according to some embodiments of the present disclosure.

FIG. 13 is a schematic diagram illustrating an exemplary speaker device acting on human skin or bones according to some embodiments of the present disclosure.

In some embodiments, a line where a driving force generated by a driving device (e.g., the driving device 1101) may be collinear or parallel to a line where the driving device vibrates. For example, a direction of a driving force may be the same as or opposite to a vibration direction of a coil and/or a magnetic circuit assembly based on a moving coil principle. In some embodiments, a panel may include a flat surface or a curved surface. In some embodiments, the panel may include a plurality of protrusions and/or grooves. In some embodiments, after the speaker device is worn on the human body of a user, a normal line of an area on the panel that is in contact with or abuts against the human body may be not parallel to the line where the driving force locates. Generally, the area on the panel that is in contact with or abuts against the human body of the user may be relatively flat. Specifically, the area on the panel that is in contact with or abuts against the human body of the user may include a plane or a quasi-plane with a relatively small curvature. When the area on the panel configured to contact or abut against the human body of the user is a plane, a normal line of a point on the area may be regarded as the normal line of the area. In this case, a normal line A of the panel 1003 and a normal line A' of the area of the panel 1003 contacted with the human skin may be parallel or coincident with each other. When the area on the panel configured to contact the human body of the user is non-planar, the normal line of the area may include an average normal line of the area. More descriptions regarding the average normal line may be found elsewhere in the present disclosure. See, e.g., FIG. 11 and the relevant descriptions thereof. In some other embodiments, when the area configured to contact the human body of the user on the panel is non-planar, the normal line of the area may be determined according to the following operations. A point in the area of the panel may be determined. The area of the panel may contact the human skin. A tangent plane of the panel at the point may be determined, and a line perpendicular to the tangent plane through the point may be determined, and the line may be regarded as the normal line of the panel. When the entire or a portion of the panel which is connected with the human skin is non-planar, selected points may be different, tangent planes at the selected points may be different, and normal lines corresponding to the tangent planes may be different. In this case, the normal line A' of the normal lines may be not parallel to the normal A of the panel. According to some embodiments of the present disclosure, an angle θ may be formed between the line where the driving force locates (or the line where the driving device vibrates) and the normal line of the area, and the angle θ may be granter than 0 and less than 180°. In some embodiments, a direction of the driving force from the panel (or the contact surface of the panel and/or the housing connected with the human skin) to the outside of the speaker device may be assumed as a positive direction of the line where the driving force locates, a direction of the normal line pointing outward the panel (or a connecting surface of the panel and/or the housing connected with the human skin) may be assumed as a positive direction of the normal line, accordingly, the angle θ may be an acute angle.

As shown in FIG. 13, in some embodiments, the speaker device may include the driving device (also referred to as a transducer device), a transmission assembly 1803, a panel 1801, and a housing 1802. In some embodiments, each of the coil 1804 and the magnetic circuit assembly 1807 may include a ring-shaped structure. In some embodiments, the driving device may adopt a moving coil type driving mode, and the driving device may include a coil 1804 and a magnetic circuit assembly 1807.

In some embodiments, an axis of the coil 1804 may be parallel to an axis of the magnetic circuit assembly 1807. The axis of the coil 1804 or the axis of the magnetic circuit assembly 1807 may be perpendicular to a radial plane of the coil 1804 and/or a radial plane of the magnetic circuit assembly 1807. In some embodiments, the coil 1804 and the magnetic circuit assembly 1807 may have the same central axis. The central axis of the coil 1804 may be perpendicular to the radial plane of the coil 1804 and pass through a geometric center of the coil 1804. The central axis and the radial plane of the circuit assembly 1807 may be vertical to each other, and the central axis of the magnetic circuit assembly 1807 may pass through the geometric center of the magnetic circuit assembly 1807. The axis of the coil 1804 or the axis of the magnetic circuit assembly 1807 and the normal line of the panel 1801 may form the aforementioned angle θ.

Merely by way of example, a relationship between the driving force and the skin deformation may be described in connection with FIG. 13. When a line where the driving forced locates, which is generated by the driving device, is parallel to the normal line of the panel 1801 (i.e., the angle is equal to zero), the relationship between the driving force and the total skin deformation may be represented by Equation (2) below:

$$F_{\perp}=S_{\perp}\times E\times A/h, \tag{2}$$

Where $F_{\perp}$ represents the driving force, $S_{\perp}$ represents the total skin deformation along a direction perpendicular to the skin, E represents an elastic modulus of the skin, A represents the contact area between the panel 1801 and the skin, and h represents a total thickness of the skin (that is, a distance between the panel 1801 and the bone).

When the line where the driving force of the driving device locates is perpendicular to the normal line of the area on the panel 1801, which is in contact with or abut against the human body of the user (i.e., the angle is 90°), the relationship between a driving force in the vertical direction and the total skin deformation may be represented by Equation (3) below:

$$F_{//}=S_{//}\times G\times A/h, \tag{3}$$

Where $F_{//}$ represents the driving force in the vertical direction, $S_{//}$ represents a total skin deformation along a direction parallel to the skin, G represents a shear modulus of the skin, A represents the contact area between the panel 1801 and the skin, and h represents the total thickness of the skin (i.e., the distance between the panel 1801 and the bone).

A relationship between shear modulus and elastic modulus may be represented by Equation (4) below:

$$G=E/2(1+\gamma), \tag{4}$$

where γ represents the Poisson's ratio of the skin, $0<\gamma<0.5$, the shear modulus is less than the elastic modulus, and $S_{//}>S_{\perp}$ under the same driving force. Generally, the Poisson's ratio of the skin may be close to 0.4.

When the line where the driving device locates is not parallel to the normal line of the area where the panel 1801 is in contact with the human body of the user, a driving force along a horizontal direction and the driving force along the vertical direction may be represented by Equation (5) and Equation (6), respectively:

$$F_{\perp}=F\times\cos(\theta), \tag{5}$$

$$F_{//}=F\times\sin(\theta), \tag{6}$$

wherein the relationship between driving force F and skin deformation S may be represented by Equation (7) below:

$$S=\sqrt[2]{S_{\perp}^2+S_{//}^2}=\frac{h}{A}\times F\times\sqrt[2]{(\cos(\theta)/E)^2+(\sin(\theta)/G)^2}, \tag{7}$$

When the Poisson's ratio of the skin is 0.4, a relationship between the angle θ and the total skin deformation may be found elsewhere in the present disclosure.

Figure 14:
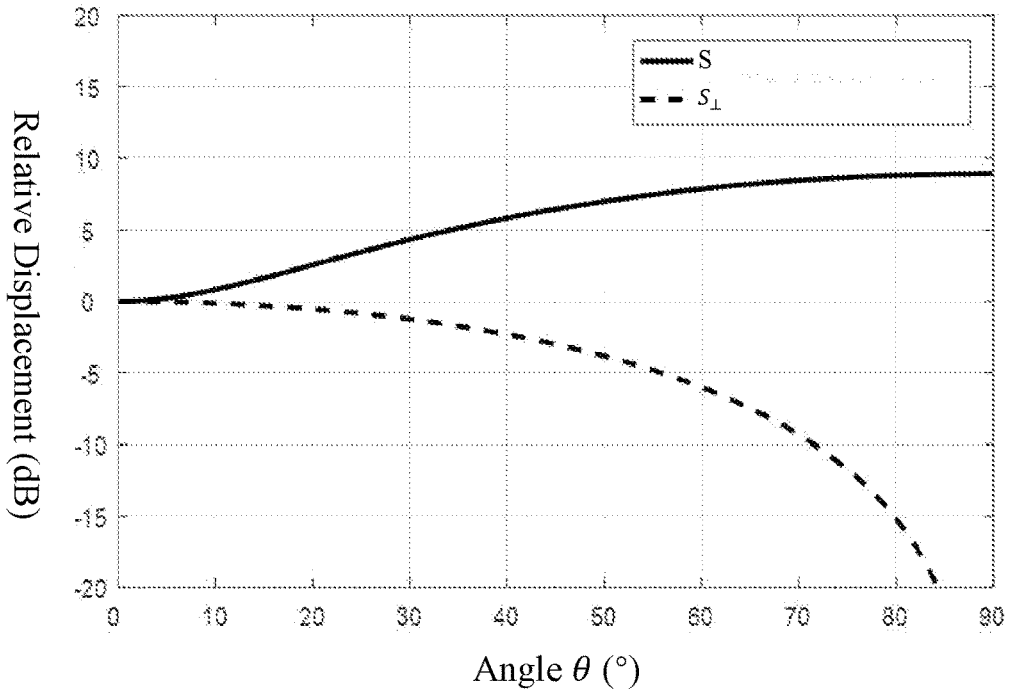
FIG. 14 is a schematic diagram illustrating a relationship between an angle and a relative displacement of an exemplary speaker device according to some embodiments of the present disclosure.

FIG. 14 is a schematic diagram illustrating a relationship between an angle and a relative displacement of an exemplary speaker device according to some embodiments of the present disclosure. As shown in FIG. 14, a relationship between an angle and a total deformation of the skin of a user may be that the greater the angle and/or the greater the relative displacement is, the greater the total deformation S is. A total skin deformation perpendicular to the skin (e.g., $S_{\perp}$) may decrease as the angle θ increases, and/or as the relative displacement decreases. When the angle θ is close to 90°, the total skin deformation along a direction perpendicular to the skin may gradually tend to zero.

In some embodiments, a part of a volume of the speaker device in a low frequency may have a positive correlation with the total skin deformation S. The greater the S is, the greater the part of the volume in the low frequency is. A part of the volume of the speaker device in a high frequency may have a positive correlation with the total skin deformation along the direction perpendicular to the skin. The greater the total skin deformation along the direction perpendicular to the skin is, the greater the part of the volume in the high frequency is.

When the Poisson's ratio of the skin is 0.4, more descriptions regarding the relationship between the angle θ, the total skin deformation S, and the $S_{\perp}$ may be described in FIG. 14. As shown in FIG. 14, the relationship between the angle θ and the total skin deformation S may be that the greater the angle θ is, the greater the total skin deformation S is, and accordingly, the greater the part of the volume of the speaker device in the low frequency is. As shown in FIG. 14, the relationship between the angle θ and the total skin deformation along the direction perpendicular to the skin $S_{\perp}$ may be that the greater the angle θ is, the less the $S_{\perp}$ is, and accordingly, the less the part of the volume in the high frequency is.

As shown in Equation (7) and FIG. 14, an increasing speed of the total skin deformation S and a decreasing speed of the $S_{\perp}$ may be different. The increasing speed of the total skin deformation S may be from a relatively fast speed to a relatively slow speed. The decreasing speed of the $S_{\perp}$ may be faster and faster. The angle θ may be determined to balance the part of the volume of the speaker device in the low frequency and the part of the volume of the speaker device in the high frequency. For example, a range of the angle θ may be 5°~80°, 15°~70°, 25°~50°, 25°~35°, 25°~30°, or the like.

Figure 15:
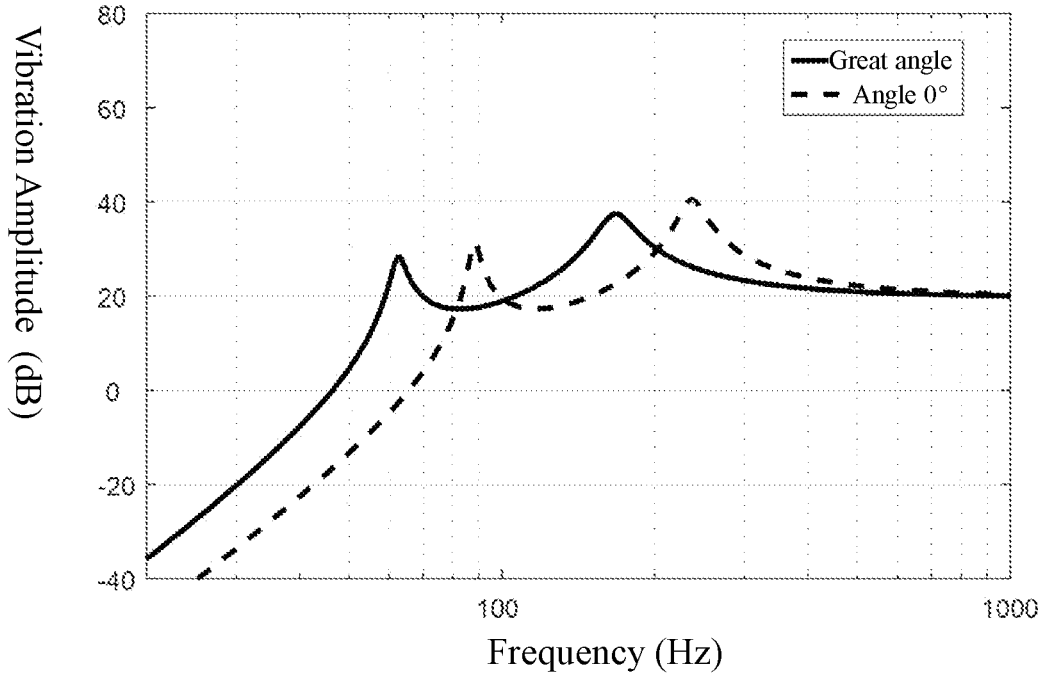
FIG. 15 is a schematic diagram illustrating a low frequency part of a frequency response curve of an exemplary speaker device corresponding to different angles θ according to some embodiments of the present disclosure.

FIG. 15 is a schematic diagram illustrating a low frequency part of a frequency response curve of an exemplary speaker device corresponding to different angles θ according to some embodiments of the present disclosure. As shown in FIG. 15, a panel is in contact with the skin of a user and transmits vibration to the skin. In this process, the skin may affect the vibration of the speaker device, thereby affecting the frequency response curve of the speaker device. As the descriptions described above, the greater the angle θ is, the greater the total skin deformation is under a same driving force. For the speaker device, the total skin deformation may be equivalent to the reduction of the elasticity of the skin relative to the panel. It can be understood that when a line where the driving force of the driving device locates and a normal line of an area of the panel, which is connected or abut against the human body of a use forms the angle θ, in particular, when the angle θ increases, a resonance peak of the low frequency part in the frequency response curve may be adjusted to a relatively low frequency part, thereby lowing the low frequency dive deeper and increasing the low frequency. Compared with other conventional techniques to improve the low-frequency components of a sound, for example, adding a vibration plate to the speaker device, setting the angle θ to improve the low frequency energy may effectively reduce the vibration sense, further significantly improving the low frequency sensitivity of the speaker device, the sound quality, and the human experience. It should be noted that, in some embodiments, the increased low frequency and the reduced vibration sense may be represented by that when the angle θ increases in the range of (0°,90°), energy of the vibration or sound signal in the low frequency range may be increased, and the vibration sense may be increased. An increment of the energy in the low-frequency range may be greater than an increment of the vibration sense. For relative effects, the vibration sense may be relatively reduced. It can be seen from FIG. 15 that when the angle θ is relatively great, the resonance peak in the low frequency area may appear in a relatively low frequency range, which may extend a flat part of the frequency curvature, thereby improving the sound quality of the speaker device.

It should be noted that the illustration of the bone conductive speaker device described above is only a specific example, and should be not regarded as the only feasible implementation. Obviously, for those skilled in the art, after understanding the basic principle of the bone conduction speaker device, it may be possible to make various modifications and changes in the forms and details of the specific methods and operations of implementing the bone conduction speaker device without departing from the principles, but these modifications and changes are still within the scope of the present disclosure. For example, a minimum angle θ between the line where the driving force of the driving device locates and the normal line of the area of the panel, which is connected or abut against the human body of a user, may be not limited to the 5°~80° described above. Merely by way of example, the angle θ may be less than 5°, for example, 1°, 2°, 3°, 4°, or the like. In some embodiments, the angle θ may be greater than 80° and less than 90°, for example, 81°, 82°, 85°, or the like. In some embodiments, a specific value of the angle θ may be not an integer (e.g., 81.3°, 81.38°, etc.). Such modifications, changes, and/or variations are all within the protection scope of the present disclosure.

Figure 16:
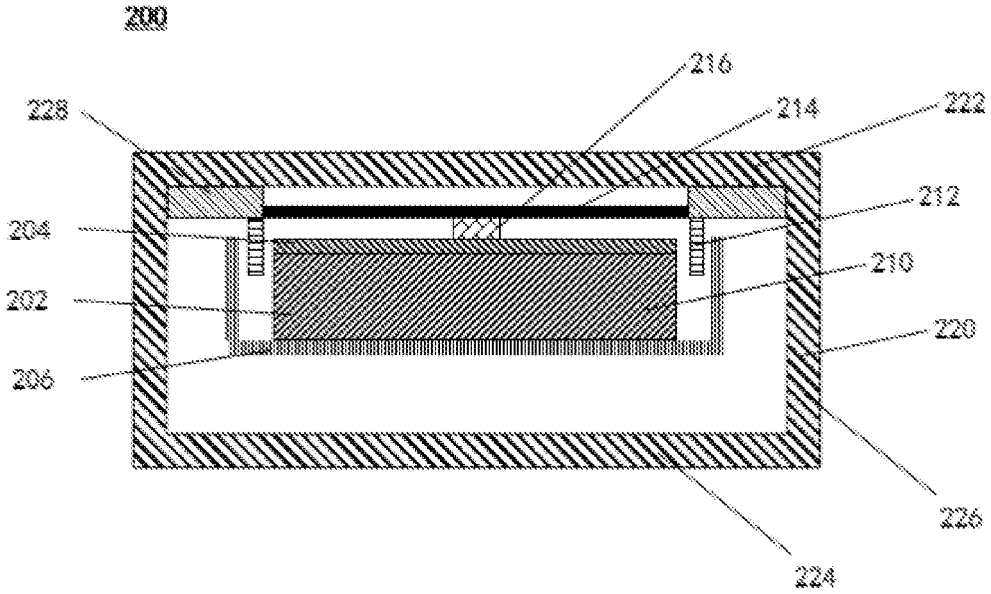
FIG. 16 is a schematic diagram illustrating a longitudinal cross-sectional view of an exemplary bone conduction speaker device according to some embodiments of the present disclosure.

FIG. 16 is a schematic diagram illustrating a longitudinal cross-sectional view of an exemplary bone conduction speaker device according to some embodiments of the present disclosure. It should be noted that the bone conduction speaker device 200 in FIG. 16 may correspond to the core housing 20 and the earphone core 50 in FIG. 2. The housing 220 may correspond to the core housing 20, and the multiple components in the housing 220 may correspond to the earphone core 50. As shown in FIG. 16, in some embodiments, the bone conduction speaker device 200 may include a magnetic circuit assembly 210, a coil 212, a vibration transmission plate 214, a connector 216, and a housing 220. In some embodiments, the magnetic circuit assembly 210 may include a first magnetic unit 202, a first magnetically conductive unit 204, and a second magnetically conductive unit 206.

In some embodiments, the housing 220 may include a housing panel 222, a housing back 224, and a housing side panel 226. The housing back 224 may be located on a side opposite to the housing panel 222 and may be arranged on two ends of the housing side panel 226, respectively. The housing panel 222, the housing back 224, and the housing side panel 226 may form an integral structure with a certain accommodation space. In some embodiments, the magnetic circuit assembly 210, the coil 212, and the vibration transmission plate 214 may be fixed inside the housing 220. In some embodiments, the bone conduction speaker device 200 may further include a housing bracket 228. The vibration transmission plate 214 may be connected to the housing 220 by the housing bracket 228, and the coil 212 may be fixed on the housing bracket 228 and may drive the housing 220 to vibrate via the housing bracket 228. In some embodiments, the housing bracket 228 may be a part of the housing 220, or may be a separate component, directly or indirectly connected to the inside of the housing 220. In some embodiments, the housing bracket 228 may be fixed on an inner surface of the housing side panel 226. In some embodiments, the housing bracket 228 may be pasted on the housing 220 via a bonding manner (e.g., using a glue), or may be fixed on the housing 220 by stamping, injection molding, clamping, riveting, threaded connecting, or welding.

In some embodiments, connection modes of the housing panel 222, the housing back 224, and the housing side panel 226 may be designed to ensure that the housing 220 has relatively large rigidity. For example, the housing panel 222, the housing back 224, and the housing side panel 226 may be integrally formed. As another example, the housing back 224 and the housing side panel 226 may be an integral structure. The housing panel 222 and the housing side panel 226 may be directly pasted and fixed in a bonding manner or fixed in a stamping manner, an injection molding manner, a clamping manner, a riveting manner, a threaded manner, a welding manner, or the like, or any combination thereof. The glue may be with strong viscosity and high hardness. As another example, the housing panel 222 and the housing side panel 226 may be an integral structure, the housing back 224 and the housing side panel 226 may be directly pasted and fixed in a bonding manner (e.g., using a glue), a clamping manner, a welding manner, a threaded manner, or the like, or any combination thereof. In some embodiments, the housing panel 222, the housing back 224, and the housing side panel 226 may be independent components, which may be fixed in a bonding manner (e.g., using a glue), a clamping manner, a welding manner, a threaded manner, or the like, or any combination thereof. For example, the housing panel 222 and the housing side panel 226 may be connected by glue, the housing back 224 and the housing side panel 226 may be connected in a clamping manner, in a welding manner, or in a threaded manner. As another example, the housing back 224 and the housing side panel 226 may be connected using glue, and the housing panel 222 and the housing side panel 226 may be connected in a clamping manner, a welding manner, or a threaded manner.

In different application scenarios, the housing illustrated in the present disclosure may be made by different assembly techniques. For example, as described elsewhere in the present disclosure, the housing may be integrally formed, and may also be formed in a separate combination manner, or a combination thereof. In the separate combination manner, different components may be fixed in a bonding manner, in a clamping manner, in a welding manner, or in a threaded manner. Specifically, in order to better understand the assembly technique of the housing of the bone conduction earphone in the present disclosure, FIGS. 17-19 describe several examples of the assembly technique of the housing.

Figure 17:
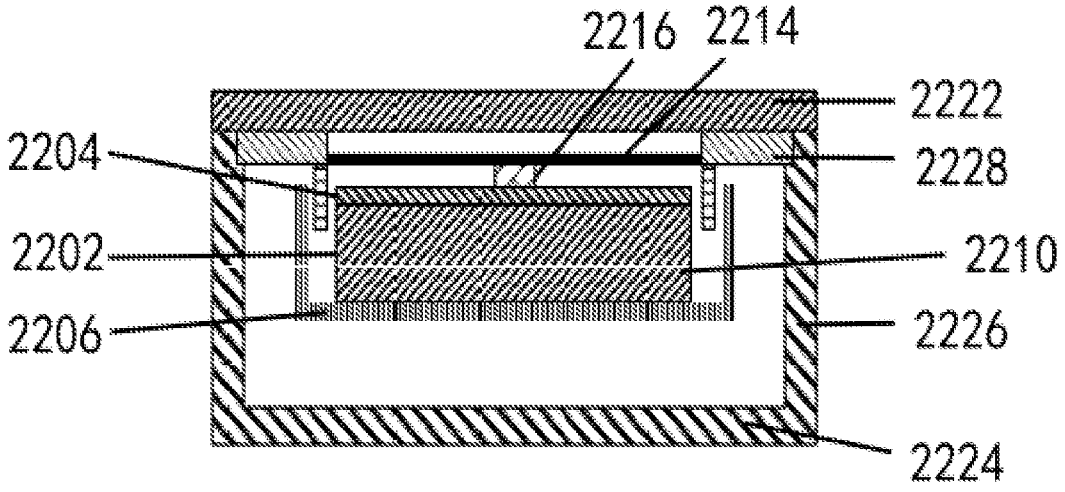
FIG. 17 is a schematic diagram illustrating an exemplary bone conduction speaker device according to some embodiments of the present disclosure.

As shown in FIG. 17, a bone conduction speaker device may mainly include a magnetic circuit assembly 2210 and a housing. In some embodiments, the magnetic circuit assembly 2210 may include a first magnetic unit 2202, a first magnetically conductive unit 2204, and a second magnetically conductive unit 2206. The housing may include a housing panel 2222, a housing back 2224, and a housing side panel 2226. The housing side panel 2226 and the housing back 2224 may be integrally formed, and the housing panel 2222 may be connected to one end of the housing side panel 2226 in a separated combination manner. The separated combination manner may include a fixing manner with glue, or fixing the housing panel 2222 to one end of the housing side panel 2226 in a clamping manner, a welding manner, a threaded manner. The housing panel 2222 and the housing side panel 2226 (or the housing back 2224) may include different, the same, or partially the same materials. In some embodiments, the housing panel 2222 and the housing side panel 2226 may include the same material, and Young's modulus of the same material may be greater than 2000 MPa. In some embodiments, Young's modulus of the same material may be greater than 4000 MPa. In some embodiments, Young's modulus of the same material may be greater than 6000 MPa. In some embodiments, Young's modulus of the material of the housing 220 may be greater than 8000 MPa. In some embodiments, Young's modulus of the same material may be greater than 12000 MPa. In some embodiments, Young's modulus of the same material may be greater than 15000 MPa. In some embodiments, Young's modulus of the same material may be greater than 18000 MPa. In some embodiments, the housing panel 2222 and the housing side panel 2226 may include different materials, and Young's modulus of the different materials may be greater than 4000 MPa. In some embodiments, Young's modulus of the different materials may be greater than 6000 MPa. In some embodiments, Young's modulus of the different materials may be greater than 8000 MPa. In some embodiments, Young's modulus of the different materials may be greater than 12000 MPa. In some embodiments, Young's modulus of the different materials may be greater than 15000 MPa. In some embodiments, Young's modulus of the different materials may be greater than 18000 MPa. In some embodiments, the material of the housing panel 2222 and/or the housing side panel 2226 may include but is not limited to AcrYlonitrile butadiene stYrene (ABS), PolYstYrene (PS), high High impact polYstYrene (HIPS), PolYpropYlene (PP), PolYethYlene terephthalate (PET), PolYester (PES), PolYcarbonate (PC)), PolYamides (PA), PolYvinYl chloride (PVC), PolYurethanes (PU), PolYvinYlidene chloride (PVC), PolYethYlene (PE), PolYmethYl methacrYlate (PMMA), PolYetheretherketone (PEEK), Phenolics (PF), Urea-formaldehYde (UF), Melamine-formaldehYde (MF), metals, alloy (such as aluminum alloy, chromium-molybdenum steel, scandium alloy, magnesium alloy, titanium alloy, magnesium-lithium alloy, nickel alloy, etc.), glass fiber or carbon fiber, or the like, or any combination thereof. In some embodiments, the material of the housing panel 2222 may include glass fiber, carbon fiber, Polycarbonate (PC), Polyamides (PA), or the like, or any combination thereof. In some embodiments, the material of the housing panel 2222 and/or the housing side panel 2226 may be made by mixing carbon fiber and polycarbonate (PC) in a certain proportion. In some embodiments, the material of the housing panel 2222 and/or the housing side panel 2226 may be made by mixing carbon fiber, glass fiber, and Polycarbonate (PC) in a certain proportion. In some embodiments, the material of the housing panel 2222 and/or the housing side panel 2226 may be made by mixing glass fiber and Polycarbonate (PC) in a certain proportion, or may be made by mixing glass fiber and Polyamides (PA) in a certain proportion.

In some embodiments, the housing panel 2222, the housing back 2224, and the housing side panel 2226 may form an integral structure with a certain accommodation space. In the integral structure, the vibration transmission plate 2214 may be connected to the magnetic circuit assembly 2210 via the connector 2216. Two ends of the magnetic circuit assembly 2210 may be connected to the first magnetically conductive unit 2204 and the second magnetically conductive unit 2206, respectively. The vibration transmission plate 2214 may be fixed inside the integral structure via the housing bracket 2228. In some embodiments, the housing side panel 2226 may have a stepped structure for supporting the housing bracket 2228. After the housing bracket 2228 is fixed on the housing side panel 2226, the housing panel 2222 may be fixed on the housing bracket 2228 and the housing side panel 2226, or fixed on the housing bracket 2228 and the housing side panel 2226, separately. In this case, alternatively, the housing side panel 2226 and the housing bracket 2228 may be integrally formed. In some embodiments, the housing bracket 2228 may be directly fixed on the housing panel 2222 (e.g., using glue, or in a clamping manner, a welding manner, a threaded manner, etc.). The fixed housing panel 2222 and housing bracket 2228 may be then fixed to the housing side panel 2226 (e.g., using glue, or in a clamping manner, a welding manner, a threaded manner, etc.). In this case, alternatively, the outer casing 2228 and the outer casing 2222 may be integrally formed.

Figure 18:
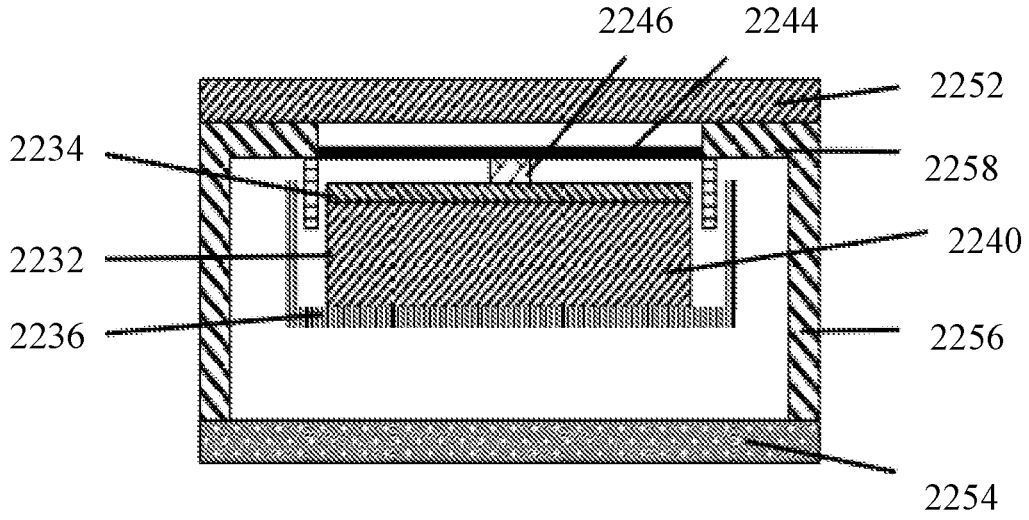
FIG. 18 is a schematic diagram illustrating an exemplary bone conduction speaker device according to some embodiments of the present disclosure.

In some embodiments, as shown in FIG. 18, a bone conduction speaker device may include a magnetic circuit assembly 2240 and a housing. The magnetic circuit assembly 2240 may include a first magnetic unit 2232, a first magnetically conductive unit 2234, and a second magnetically conductive unit 2236. In the integral structure, a vibration transmission plate 2244 may be connected to the magnetic circuit assembly 2240 via a connector 2246. Difference between the bone conduction speaker device illustrated in FIG. 18 and the bone conduction speaker device illustrated in FIG. 17 is that a housing bracket 2258 and the housing side panel 2256 of the bone conduction speaker device in FIG. 18 may be integrally formed. The housing panel 2252 may be fixed to an end of the housing side panel 2256 connected to the housing bracket 2258 (e.g., in a bonding manner, a clamping manner, a welding manner, a threaded manner, etc.), and the housing back 2254 may be fixed to the other end of the housing side panel 2256 (e.g., using a glue, in a clamping manner, a welding manner, a threaded manner, etc.). In this case, alternatively, the housing bracket 2258 and the housing side panel 2256 may be separate structures that are combined together. The housing panel 2252, the housing back 2254, the housing bracket 2258, and the housing side panel 2256 may be fixedly connected in a bonding manner, in a clamping manner, in a welding manner, in a threaded manner, etc.

Figure 19:
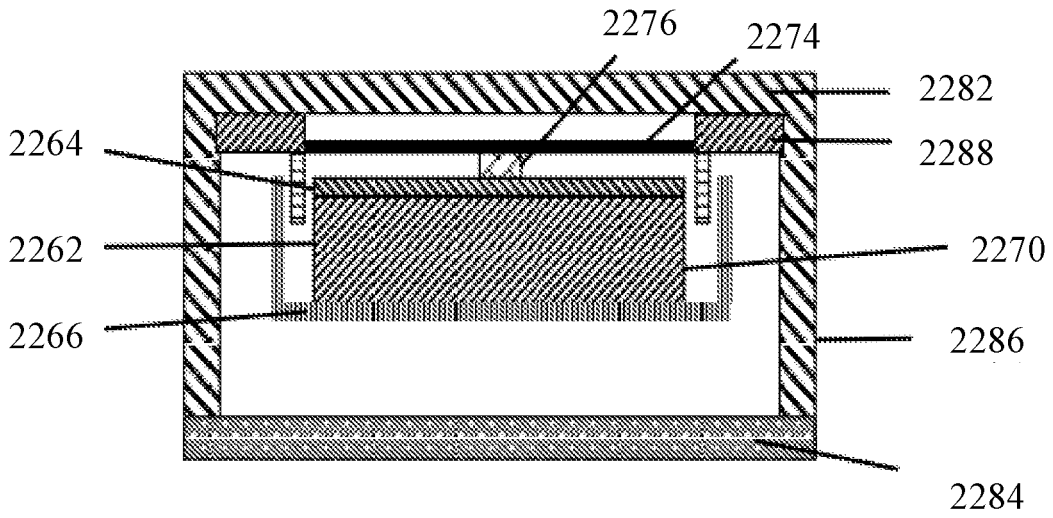
FIG. 19 is a schematic diagram illustrating an exemplary bone conduction speaker device according to some embodiments of the present disclosure.

In another specific embodiment, as shown in FIG. 19, the bone conduction speaker in the embodiment may include a magnetic circuit assembly 2270 and a housing. The magnetic circuit assembly 2270 may include a first magnetic unit 2262, a first magnetically conductive unit 2264, and a second magnetically conductive unit 2266. In the integral structure, a vibration transmission plate 2274 may be connected to the magnetic circuit assembly 2270 via a connector 2276. Difference between the bone conduction speaker device illustrated in FIG. 19 and the bone conduction speaker device illustrated in FIG. 18 is that a housing panel 2282 and a housing side panel 2286 of the conduction speaker device in FIG. 19 may be integrally formed. The housing back 2284 may be fixed on an end of the housing side panel 2286 opposite to the housing side panel 2282 (e.g., in a glue manner, a clamping manner, a welding manner, a threaded manner, etc.). The housing bracket 2288 may be fixed on the housing panel 2282 and/or the housing side 2286 in a bonding manner, a clamping manner, a welding manner, or a threaded manner. In this case, alternatively, the housing bracket 2288, the housing panel 2282, and the housing side panel 2286 may be integrally formed.

Figure 20:
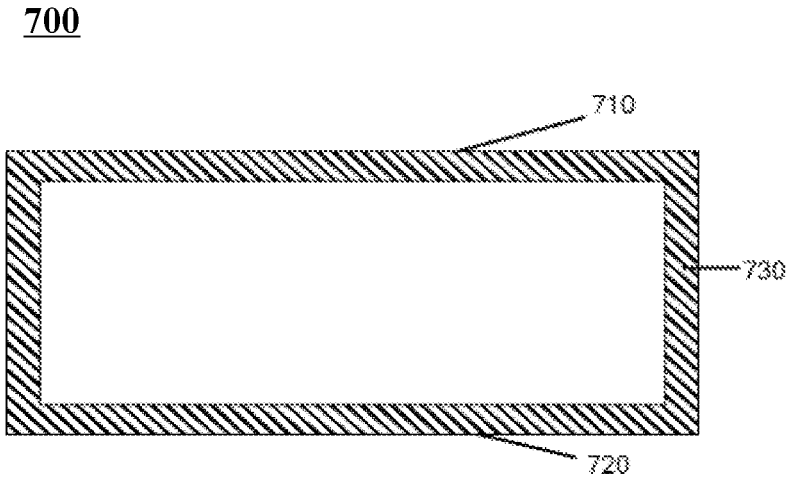
FIG. 20 is a schematic diagram illustrating a housing of a bone conduction speaker device according to some embodiments of the present disclosure.

FIG. 20 is a schematic diagram illustrating a housing of a bone conduction speaker device according to some embodiments of the present disclosure. As shown in FIG. 20, the housing 700 may include a housing panel 710, a housing back 720, and a housing side panel 730. The housing panel 710 may be in contact with the human body and transmit vibration of the bone conduction speaker device to the auditory nerve of a user. In some embodiments, when an overall rigidity of the housing 700 is relatively large, vibration amplitudes and phases of the housing panel 710 and those of the housing back 720 may be the same or substantially the same (e.g., the housing side panel 730 may not compress air and may not generate sound leakage) within a certain frequency range, so that a first leaked sound signal generated by the housing panel 710 and a second leaked sound signal generated by the housing back 720 may be superimposed (or overlap) on each other. The superposition may reduce the amplitude of the first leaked sound wave or that of the second leaked sound wave, thereby reducing the sound leakage of the housing 700. In some embodiments, the certain frequency range may at least include a frequency greater than 500 Hz. In some embodiments, the certain frequency range may at least include a frequency greater than 600 Hz. In some embodiments, the certain frequency range may at least include a frequency greater than 800 Hz. In some embodiments, the certain frequency range may at least include a frequency greater than 1000 Hz. In some embodiments, the certain frequency range may at least include a frequency greater than 2000 Hz. In some embodiments, the certain frequency range may at least include a frequency greater than 5000 Hz. In some embodiments, the certain frequency range may at least include a frequency greater than 8000 Hz. In some embodiments, the certain frequency range may at least include a frequency greater than 10000 Hz.

In some embodiments, the rigidity of the housing 700 of the bone conduction speaker device may affect the vibration amplitudes and phases of different parts (e.g., the housing panel 710, the housing back 720, and/or the housing side panel 730) of the housing 700, thereby affecting the sound leakage of the bone conduction speaker device. In some embodiments, when the housing 700 of the bone conduction speaker device has a relatively great rigidity, the housing panel 710 and the housing back 720 may have the same or substantially the same vibration amplitude and phase at a relatively high frequency, thereby significantly reducing the sound leakage of the bone conduction speaker device.

In some embodiments, the relatively high frequency may include a frequency not less than 1000 Hz, for example, a frequency between 1000 Hz and 2000 Hz, a frequency between 1100 Hz and 2000 Hz, a frequency between 1300 Hz and 2000 Hz, a frequency between 1500 Hz and 2000 Hz, a frequency between 1700 Hz-2000 Hz, a frequency between 1900 Hz-2000 Hz. In some embodiments, the relatively high frequency mentioned herein may include a frequency not less than 2000 Hz, for example, a frequency between 2000 Hz and 3000 Hz, a frequency between 2100 Hz and 3000 Hz, a frequency between 2300 Hz and 3000 Hz, a frequency between 2500 Hz and 3000 Hz, a frequency between 2700 Hz-3000 Hz, or a frequency between 2900 Hz-3000 Hz. In some embodiments, the relatively high frequency may include a frequency not less than 4000 Hz, for example, a frequency between 4000 Hz and 5000 Hz, a frequency between 4100 Hz and 5000 Hz, a frequency between 4300 Hz and 5000 Hz, a frequency between 4500

Hz and 5000 Hz, a frequency between 4700 Hz and 5000 Hz, or a frequency between 4900 Hz-5000 Hz. In some embodiments, the relatively high frequency may include a frequency not less than 6000 Hz, for example, a frequency between 6000 Hz and 8000 Hz, a frequency between 6100 Hz and 8000 Hz, a frequency between 6300 Hz and 8000 Hz, a frequency between 6500 Hz and 8000 Hz, a frequency between 7000 Hz and 8000 Hz, a frequency between 7500 Hz and 8000 Hz, or a frequency between 7900 Hz and 8000 Hz. In some embodiments, the relatively high frequency may include a frequency not less than 8000 Hz, for example, a frequency between 8000 Hz and 12000 Hz, a frequency between 8100 Hz and 12000 Hz, a frequency between 8300 Hz and 12000 Hz, a frequency between 8500 Hz and 12000 Hz, a frequency between 9000 Hz and 12000 Hz, a frequency between 10000 Hz and 12000 Hz, or a frequency between 11000 Hz and 12000 Hz.

That the vibration amplitude of the housing panel 710 and that of the housing back 720 may be the same or substantially the same refers that a ratio of the vibration amplitude of the housing panel 710 and that of the housing back 720 may be within a certain range. In some embodiments, the ratio of the vibration amplitude of the housing panel 710 and that of the housing back 720 may be between 0.3 and 3. In some embodiments, the ratio of the vibration amplitude of the housing panel 710 and that of the housing back 720 may be between 0.4 and 2.5. In some embodiments, the ratio of the vibration amplitude of the housing panel 710 and that of the housing back 720 may be between 0.5 and 1.5. In some embodiments, the ratio of the vibration amplitude of the housing panel 710 and that of the housing back 720 may be between 0.6 and 1.4. In some embodiments, the ratio of the vibration amplitude of the housing panel 710 and that of the housing back 720 may be between 0.7 and 1.2. In some embodiments, the ratio of the vibration amplitude of the housing panel 710 and that of the housing back 720 may be between 0.75 and 1.15. In some embodiments, the ratio of the vibration amplitude of the housing panel 710 and that of the housing back 720 may be between 0.8 and 1.1. In some embodiments, the ratio of the vibration amplitude of the housing panel 710 and that of the housing back 720 may be between 0.9 and 1.05. In some embodiments, the vibrations of the housing panel 710 and the housing back 720 may be represented by other physical quantities that can characterize the vibration amplitude. For example, sound pressures generated by the housing panel 710 and the housing back 720 at a point in the space may be used to represent the vibration amplitudes of the housing panel 710 and the housing back 720.

That the vibration phase of the housing panel 710 and that of the housing back 720 may be the same or substantially the same refers that a difference between the vibration phase of the housing panel 710 and the vibration phase of the housing back 720 may be within a certain range. In some embodiments, the difference between the vibration phases of the housing panel 710 and the housing back 720 may be between −90° and 90°. In some embodiments, the difference between the vibration phases of the housing panel 710 and the housing back 720 may be between −80° and 80°. In some embodiments, the difference between the vibration phases of the housing panel 710 and the housing back 720 may be between −60° and 60°. In some embodiments, the difference between the vibration phases of the housing panel 710 and the housing back 720 may be between −45° and 45°. In some embodiments, the difference between the vibration phases of the housing panel 710 and the housing back 720 may be between −30° and 30°. In some embodiments, the difference between the vibration phases of the housing panel 710 and the housing back 720 may be between −20° and 20°. In some embodiments, the difference between the vibration phases of the housing panel 710 and the housing back 720 may be between −15° and 15°. In some embodiments, the difference between the vibration phases of the housing panel 710 and the housing back 720 may be between −12° and 12°. In some embodiments, the difference between the vibration phases of the housing panel 710 and the housing back 720 may be between −10° and 10°. In some embodiments, the difference between the vibration phases of the housing panel and the housing back may be between −8° and 8°. In some embodiments, the difference between the vibration phases of the housing panel and the housing back may be between −6° and 6°. In some embodiments, the difference between the vibration phases of the housing panel and the housing back may be between −5° and 5°. In some embodiments, the difference between the vibration phases of the housing panel and the housing back may be between −4° and 4°. In some embodiments, the difference between the vibration phases of the housing panel and the housing back may be between −3° and 3°. In some embodiments, the difference between the vibration phases of the housing panel 710 and the housing back 720 may be between −2° and 2°. In some embodiments, the difference between the vibration phases of the housing panel 710 and the housing back 720 may be between −1° and 1°. In some embodiments, the difference between the vibration phases of the housing panel 710 and the housing back 720 may be 0°. In some embodiments, an absolute value of a difference between the first phase and the second phase may be less than 60°. For example, when a frequency of each of the vibration of the housing panel and the vibration of the housing back panel is between 2000 Hz and 3000 Hz, the absolute value of the difference between the first phase and the second phase may be 1°, 2°, 5°, 10°, 15°, 20°, 30°, 40°, 50°, 55°, 60°, etc.

It should be noted that the descriptions regarding the bone conduction speaker device described above are only specific examples, and should be not regarded as the only feasible implementations. Obviously, for those skilled in the art, after understanding the basic principle of the bone conduction speaker device, it may be possible to make various modifications and changes in the forms and details of the specific methods and operations of implementing the bone conduction speaker device without departing from the principles, but these modifications and changes are still within the scope of the present disclosure. For example, the housing side panel 730, the housing back 720, and the housing bracket may be integrally formed. Such modifications, changes, and/or variations are still within the protection scope of the present disclosure.

Figure 21:
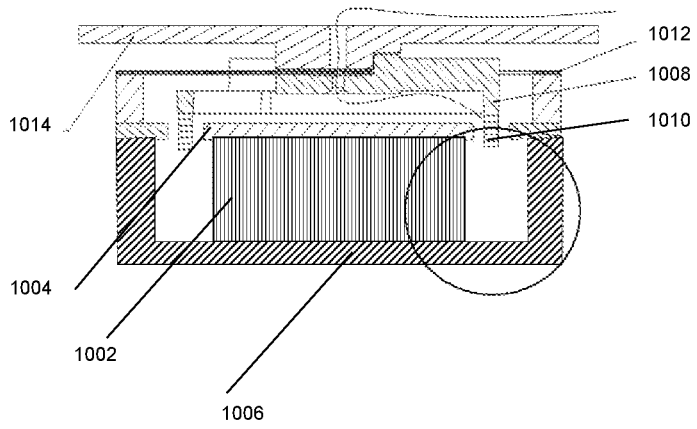
FIG. 21 is a schematic diagram illustrating a longitudinal sectional view of an exemplary speaker device according to some embodiments of the present disclosure.

FIG. 21 is a schematic diagram illustrating a longitudinal sectional view of an exemplary speaker device according to some embodiments of the present disclosure. As shown in FIG. 21, a speaker device 1000 may include a first magnetic unit 1002, a first magnetically conductive unit 1004, a second magnetically conductive unit 1006, a first vibration plate 1008, a voice coil 1010, a second vibration plate 1012, and a vibration panel 1014. One or more units of an earphone core of the speaker device 1000 may correspond to a magnetic circuit assembly. In some embodiments, the magnetic circuit assembly may include the first magnetic unit 1002, the first magnetically conductive unit 1004, and the second magnetically conductive unit 1006. The magnetic circuit assembly may generate a first total magnetic field (also referred to as "total magnetic field of the magnetic circuit assembly" or "first magnetic field").

The magnetic unit described in the present disclosure may refer to a unit that generates a magnetic field, such as a magnet. The magnetic unit may have a magnetization direction. The magnetization direction may refer to a direction of a magnetic field inside the magnetic unit. In some embodiments, the first magnetic unit 1002 may include one or more magnets. The first magnetic unit may generate a second magnetic field. In some embodiments, the magnet may include a metal alloy magnet, ferrite, or the like. The metal alloy magnet may include neodymium iron boron, samarium cobalt, aluminum nickel cobalt, iron chromium cobalt, aluminum iron boron, iron carbon aluminum, or the like, or any combination thereof. The ferrite may include barium ferrite, steel ferrite, manganese ferrite, lithium manganese ferrite, or the like, or any combination thereof.

In some embodiments, a lower surface of the first magnetically conductive unit 1004 may be connected to an upper surface of the first magnetic unit 1002. The second magnetically conductive unit 1006 may be connected to the first magnetic unit 1002. It should be noted that the magnetically conductive unit used herein may refer to a magnetic field concentrator or an iron core. The magnetically conductive unit may adjust distribution of a magnetic field (e.g., the second magnetic field generated by the first magnetic unit 1002). The magnetically conductive unit may include a unit made of a soft magnetic material. In some embodiments, the soft magnetic material may include a metal material, a metal alloy, a metal oxide material, an amorphous metal material, etc., such as iron, an iron-silicon alloy, an iron-aluminum alloy, a nickel-iron alloy, an iron-cobalt series alloy, a low carbon steel, a silicon steel sheet, a silicon steel sheet, a ferrite, etc. In some embodiments, the magnetically conductive unit may be processed by casting, plastic processing, cutting processing, powder metallurgy, or the like, or any combination thereof. The casting may include sand casting, investment casting, pressure casting, centrifugal casting, etc. The plastic processing may include rolling, casting, forging, stamping, extrusion, drawing, or the like, or any combination thereof. The cutting processing may include turning, milling, planing, grinding, or the like. In some embodiments, a processing mode of the magnetically conductive unit may include 3D printing, CNC machine tools, or the like. A connection manner between the first magnetically conductive unit 1004, the second magnetically conductive unit 1006, and the first magnetic unit 1002 may include a bonding manner, a snapping manner, a welding manner, a riveting manner, a bolting manner, or the like, or any combination thereof. In some embodiments, the first magnetic unit 1002, the first magnetically conductive unit 1004, and the second magnetically conductive unit 1006 may be set as an axisymmetric structure. The axisymmetric structure may be a ring structure, a columnar structure, or other axisymmetric structures.

In some embodiments, a magnetic gap may form between the first magnetic unit 1002 and the second magnetically conductive unit 1006. The voice coil 1010 may be disposed in the magnetic gap. The voice coil 1010 may be connected to the first vibration plate 1008. The first vibration plate 1008 may be connected to the second vibration plate 1012. The second vibration plate 1012 may be connected to the vibration panel 1014. When a current is conducted into the voice coil 1010, the voice coil 1010 may be located in a magnetic field formed by the first magnetic unit 1002, the first magnetically conductive unit 1004, and/or the second magnetically conductive unit 1006, and may be affected by an ampere force. The ampere force may drive the voice coil 1010 to vibrate, and the vibration of the voice coil 1010 may drive the first vibration plate 1008, the second vibration plate 1012, and/or the vibration panel 1014 to vibrate. The vibration panel 1014 may transmit the vibration to the auditory nerve through tissues and bones, so that a person (e.g., a user of the speaker device) may hear a sound. The vibration panel 1014 may be in direct contact with human skins, or contact with the skins through a vibration transmission layer made of a specific material.

In some embodiments, for a speaker device with a single magnetic unit, magnetic induction line(s) passing through the voice coil maybe not uniform and/or divergent. Magnetic leakage may be formed in the magnetic circuit. That is, more magnetic induction lines may leak outside the magnetic gap and fail to pass through the voice coil 1010. Magnetic induction strength (or magnetic field intensity) at a position of the voice coil 1010 may decrease, which may affect the sensitivity of the speaker device. In some embodiments, the speaker device may further include at least one second magnetic unit and/or at least one third magnetically conductive unit (not shown in FIG. 21). The at least one second magnetic unit and/or the at least one third magnetically conductive unit may suppress the leakage of the magnetic induction lines and restrict the route of the magnetic induction lines passing through the voice coil 1010. Relatively more magnetic induction lines may pass through the voice coil 1010 as horizontally and densely as possible to increase the magnetic induction strength (or magnetic field intensity) at a position of the voice coil 1010, thereby increasing the sensitivity of the speaker device 1000, and further improving the mechanical conversion efficiency of the speaker device 1000 (e.g., the efficiency of converting the input power of the speaker device 1000 into the mechanical energy of the vibration of the voice coil).

Figure 22:
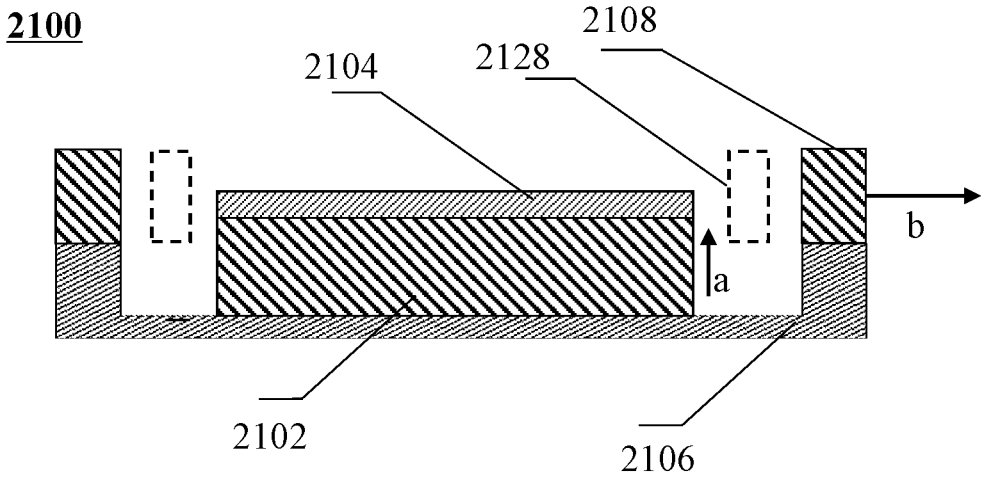
FIG. 22 is a schematic diagram illustrating a longitudinal sectional view of a magnetic circuit assembly according to some embodiments of the present disclosure.

FIG. 22 is a schematic diagram illustrating a longitudinal sectional view of a magnetic circuit assembly 2100 according to some embodiments of the present disclosure. As shown in FIG. 22, the magnetic circuit assembly 2100 may include a first magnetic unit 2102, a first magnetically conductive unit 2104, a second magnetically conductive unit 2106, and a second magnetic unit 2108. In some embodiments, the first magnetic unit 2102 and/or the second magnetic unit 2108 may include one or more magnets described in the present disclosure. In some embodiments, the first magnetic unit 2102 may include a first magnet, and the second magnetic unit 2108 may include a second magnet. The first magnet may be the same as or different from the second magnet. The first magnetically conductive unit 2104 and/or the second magnetically conductive unit 2106 may include one or more magnetically conductive materials described in the present disclosure. A processing manner of the first magnetically conductive unit 2104 and/or the second magnetically conductive unit 2106 may include one or more processing manners described in the present disclosure. In some embodiments, the first magnetic unit 2102 and/or the first magnetically conductive unit 2104 may be disposed as an axisymmetric structure. For example, a shape of the first magnetic unit 2102 and/or the first magnetically conductive unit 2104 may be a cylinder, a cuboid, or a hollow ring (e.g., a cross-section of the first magnetic unit 2102 and/or the first magnetically conductive unit 210 may be with a shape of a runway). In some embodiments, the first magnetic unit 2102 and the first magnetically conductive unit 2104 may be coaxial cylinders with the same or different diameters. In some embodiments, the second magnetically conductive unit 2106 may include a groove-type structure. The groove-type structure may include a U-shaped section (as shown in FIG. 21). The second magnetically conductive unit 2106 with the groove-type structure may include a bottom plate and a sidewall. In some embodiments, the bottom plate and the sidewall may be integrally formed as a whole. For example, the sidewall may be formed by extending the bottom plate in a direction perpendicular to the bottom plate. In some embodiments, the bottom plate may be connected to the sidewall through one or more connection manners described in the present disclosure. The second magnetic unit 2108 may be disposed with a ring shape or a sheet shape. In some embodiments, the second magnetic unit 2108 may be disposed with the ring shape. The second magnetic unit 2108 may include an inner ring and an outer ring. In some embodiments, the second magnetic unit 2108 may surround the first magnetic unit 2102. In some embodiments, a shape of the inner ring and/or the outer ring may be a ring, an ellipse, a triangle, a quadrangle, or any other polygons. In some embodiments, the second magnetic unit 2108 may be formed by arranging a number of magnets. Both ends of any one of the number of magnets may be connected to or have a certain distance from both ends of an adjacent magnet. The spacing between the magnets may be the same or different. In some embodiments, the second magnetic unit 2108 may be formed by arranging two or three sheet-shaped magnets equidistantly. The shape of the sheet-shaped magnet may include a fan shape, a quadrangular shape, or the like. In some embodiments, the second magnetic unit 2108 may be coaxial with the first magnetic unit 2102 and/or the first magnetically conductive unit 2104.

In some embodiments, an upper surface of the first magnetic unit 2102 may be connected to a lower surface of the first magnetically conductive unit 2104. The lower surface of the first magnetic unit 2102 may be connected to the bottom plate of the second magnetically conductive unit 2106. The lower surface of the second magnetic unit 2108 may be connected to the sidewall of the second magnetically conductive unit 2106. The connection manner between the first magnetic unit 2102, the first magnetically conductive unit 2104, the second magnetically conductive unit 2106, and/or the second magnetic unit 2108 may include a bonding manner, a snapping manner, a welding manner, a riveting manner, a bolting manner, or the like, or any combination thereof.

In some embodiments, a magnetic gap may be formed between the first magnetic unit 2102 and/or the first magnetically conductive unit 2104 and the inner ring of the second magnetic unit 2108. A voice coil 2128 may be disposed in the magnetic gap. In some embodiments, a height of the second magnetic unit 2108 and a height of the voice coil 2128 relative to the bottom plate of the second magnetically conductive unit 2106 may be equal. In some embodiments, the first magnetic unit 2102, the first magnetically conductive unit 2104, the second magnetically conductive unit 2106, and the second magnetic unit 2108 may form a magnetic circuit. In some embodiments, the magnetic circuit assembly 2100 may generate a first total magnetic field (also referred to as "total magnetic field of magnetic circuit assembly" or "first magnetic field"). The first magnetic unit 2102 may generate a second magnetic field. The first total magnetic field may be formed by magnetic fields generated by all components (e.g., the first magnetic unit 2102, the first magnetically conductive unit 2104, the second magnetically conductive unit 2106, and/or the second magnetic unit 2108) in the magnetic circuit assembly 2100. Magnetic field strength (also referred to as magnetic induction intensity, magnetic field intensity, or magnetic flux density) of the first total magnetic field in the magnetic gap may be greater than magnetic field intensity of the second magnetic field in the magnetic gap. In some embodiments, the second magnetic unit 2108 may generate a third magnetic field. The third magnetic field may increase the magnetic field intensity of the first total magnetic field in the magnetic gap. The third magnetic field increasing the magnetic field intensity of the first total magnetic field herein may refer to that the magnetic strength of the first total magnetic field in the magnetic gap when the third magnetic field exists (e.g., the second magnetic unit 2108 exists) may be greater than that of the first total magnetic field when the third magnetic field does not exist (e.g., the second magnetic unit 2108 does not exist). In some embodiments, unless otherwise specified, the magnetic circuit assembly may refer to a structure including all magnetic units and magnetically conductive units. The first total magnetic field may represent the magnetic field generated by the magnetic circuit assembly as a whole. The second magnetic field, the third magnetic field, . . . , and the N-th magnetic field may respectively represent a magnetic field generated by a corresponding magnetic unit. In some embodiments, the magnetic unit that generates the second magnetic field (e.g., the third magnetic field, . . . , or the N-th magnetic field) may be the same or different.

In some embodiments, an included angle between a magnetization direction of the first magnetic unit 2102 and a magnetization direction of the second magnetic unit 2108 may be between 0 degrees and 180 degrees. In some embodiments, the included angle between the magnetization direction of the first magnetic unit 2102 and the magnetization direction of the second magnetic unit 2108 may be between 45 degrees and 135 degrees. In some embodiments, the induced angle between the magnetization direction of the first magnetic unit 2102 and the magnetization direction of the second magnetic unit 2108 may be equal to or greater than 90 degrees. In some embodiments, the magnetization direction of the first magnetic unit 2102 may be perpendicular to the lower surface or the upper surface of the first magnetic unit 2102 and be vertically upward (a direction as indicated by an arrow a in FIG. 22). The magnetization direction of the second magnetic unit 2108 may be directed from the inner ring of the second magnetic unit 2108 to the outer ring of the second magnetic unit 2108 (e.g., a direction as indicated by an arrow b on a right side of the first magnetic unit 2102 in FIG. 22, the magnetization direction of the first magnetic unit 2102 may deflect 90 degrees in a clockwise direction).

In some embodiments, at a position of the second magnetic unit 2108, an included angle between the direction of the first total magnetic field and the magnetization direction of the second magnetic unit 2108 may be not greater than 90 degrees. In some embodiments, at the position of the second magnetic unit 2108, the included angle between a direction of the magnetic field generated by the first magnetic unit 2102 and the direction of the magnetization of the second magnetic unit 2108 may be less than or equal to 90 degrees, such as 0 degrees, 10 degrees, 20 degrees, or the like.

Compared with a magnetic circuit assembly with a single magnetic unit, the second magnetic unit 2108 may increase the total magnetic flux in the magnetic gap of the magnetic circuit assembly 2100, thereby increasing the magnetic induction strength in the magnetic gap. And, under an action of the second magnetic unit 2108, originally scattered magnetic induction lines may converge to the position of the magnetic gap, which may further increase the magnetic induction strength in the magnetic gap.

Figure 23:
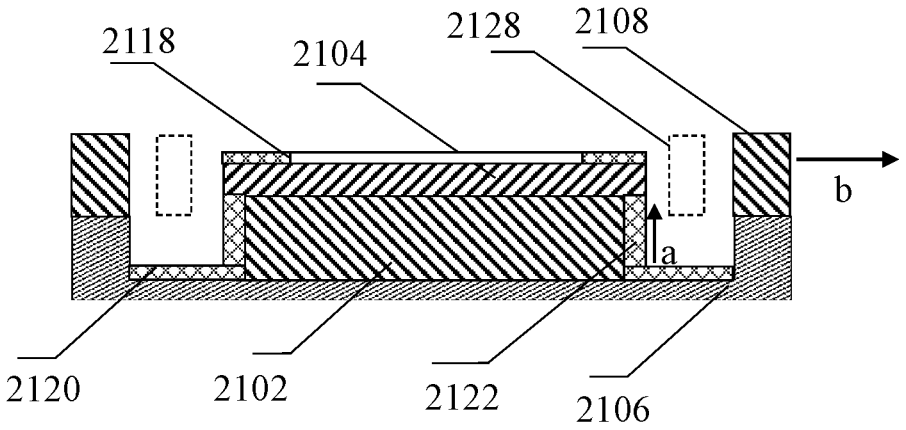
FIG. 23 is a schematic diagram illustrating a longitudinal sectional view of a magnetic circuit assembly according to some embodiments of the present disclosure.

FIG. 23 is a schematic diagram illustrating a longitudinal sectional view of a magnetic circuit assembly according to some embodiments of the present disclosure. As shown in FIG. 23, different from the magnetic circuit assembly 2100 shown in FIG. 22, the magnetic circuit assembly 2600 may include at least one electrically conductive unit (e.g., a first electrically conductive unit 2118, a second electrically conductive unit 2120, and a third electrically conductive unit 2122).

The at least one electrically conductive unit may include a metal material, a metal alloy material, an inorganic non-metal material, or other conductive materials. The metal material may include gold, silver, copper, aluminum, etc. The metal alloy material may include an iron-based alloy, an aluminum-based alloy material, a copper-based alloy, a zinc-based alloy, etc. The inorganic non-metal material may include graphite, etc. The at least one electrically conductive unit may include a sheet shape, a ring shape, a mesh shape, or the like. The first electrically conductive unit 2118 may be disposed on an upper surface of the first magnetically conductive unit 2104. The second electrically conductive unit 2120 may be connected to the first magnetic unit 2102 and the second magnetically conductive unit 2106. The third electrically conductive unit 2122 may be connected to a sidewall of the first magnetic unit 2102. In some embodiments, the first magnetically conductive unit 2104 may protrude from the first magnetic unit 2102 to form a first recessed area portion. The third electrically conductive unit 2122 may be disposed on the first recessed area portion. In some embodiments, the first electrically conductive unit 2118, the second electrically conductive unit 2120, and the third electrically conductive unit 2122 may include the same or different conductive materials. The first electrically conductive unit 2118, the second electrically conductive unit 2120, and/or the third electrically conductive unit 2122 may be respectively connected to the first magnetically conductive unit 2104, the second magnetically conductive unit 2106 and/or the first magnetic unit 2102 in one or more connection manners described in the present disclosure.

A magnetic gap may be formed between the first magnetic unit 2102, the first magnetically conductive unit 2104, and the inner ring of the second magnetic unit 2108. A voice coil 2128 may be disposed in the magnetic gap. The first magnetic unit 2102, the first magnetically conductive unit 2104, the second magnetically conductive unit 2106, and the second magnetic unit 2108 may form a magnetic circuit. In some embodiments, the electrically conductive unit may reduce an inductive reactance of the voice coil 2128. For example, if a first alternating current flows through the voice coil 2128, a first alternating induced magnetic field may be generated near the voice coil 2128. Under the affection of the magnetic field in the magnetic circuit, the first alternating induced magnetic field may cause the voice coil 2128 to generate the inductive reactance, thereby hindering a movement of the voice coil 2128. When an electrically conductive unit (e.g., the first electrically conductive unit 2118, the second electrically conductive unit 2120, and/or the third electrically conductive unit 2122) is disposed near the voice coil 2128, the electrically conductive unit may induce a second alternating current under the action of the first alternating induced magnetic field. A third alternating current in the electrically conductive unit may generate a second alternating induced magnetic field near the third alternating current. A direction of the second alternating induction magnetic field may be opposite to that of the first alternating induction magnetic field, thereby weakening the first alternating induction magnetic field, reducing the inductive reactance of the voice coil 2128, increasing the current in the voice coil, and improving the sensitivity of a speaker device.

Figure 24:
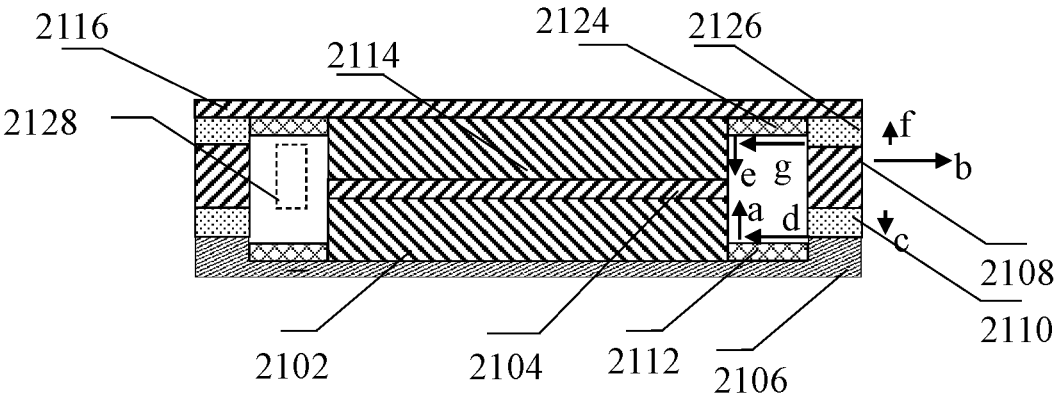
FIG. 24 is a schematic diagram illustrating a longitudinal sectional view of a magnetic circuit assembly according to some embodiments of the present disclosure.

FIG. 24 is a schematic diagram illustrating a longitudinal sectional view of a magnetic circuit assembly according to some embodiments of the present disclosure. As shown in FIG. 24, different from the magnetic circuit assembly 2600 shown in FIG. 23, the magnetic circuit assembly 2700 may include a third magnetic unit 2110, a fourth magnetic unit 2112, a fifth magnetic unit 2114, a third magnetically conductive unit 2116, a sixth magnetic unit 2124, and a seventh magnetic unit 2126. The third magnetic unit 2110, the fourth magnetic unit 2112, the fifth magnetic unit 2114, the third magnetically conductive unit 2116, the sixth magnetic unit 2124, and/or the seventh magnetic unit 2126 may be disposed as coaxial ring cylinders.

In some embodiments, an upper surface of the second magnetic unit 2108 may be connected to the seventh magnetic unit 2126. A lower surface of the second magnetic unit 2108 may be connected to the third magnetic unit 2110. The third magnetic unit 2110 may be connected to the second magnetically conductive unit 2106. An upper surface of the seventh magnetic unit 2126 may be connected to the third magnetically conductive unit 2116. The fourth magnetic unit 2112 may be connected to the second magnetically conductive unit 2106 and the first magnetic unit 2102. The sixth magnetic unit 2124 may be connected to the fifth magnetic unit 2114, the third magnetically conductive unit 2116, and the seventh magnetic unit 2126. In some embodiments, the first magnetic unit 2102, the first magnetically conductive unit 2104, the second magnetically conductive unit 2106, the second magnetic unit 2108, the third magnetic unit 2110, the fourth magnetic unit 2112, the fifth magnetic unit 2114, the third magnetically conductive unit 2116, the sixth magnetic unit 2124, and the seventh magnetic unit 2126 may form a magnetic circuit and a magnetic gap.

In some embodiments, an included angle between a magnetization direction of the first magnetic unit 2102 and a magnetization direction of the sixth magnetic unit 2124 may be between 0 degrees and 180 degrees. In some embodiments, the included angle between the magnetization direction of the first magnetic unit 2102 and the magnetization direction of the sixth magnetic unit 2124 may be between 45 degrees and 135 degrees. In some embodiments, the included angle between the magnetization direction of the first magnetic unit 2102 and the magnetization direction of the sixth magnetic unit 2124 maybe not greater than 90 degrees. In some embodiments, the magnetization direction of the first magnetic unit 2102 may be perpendicular to a lower surface or an upper surface of the first magnetic unit 2102 and be vertically upward (e.g., a direction indicated by an arrow a in the FIG. 24). The magnetization direction of the sixth magnetic unit 2124 may be directed from an outer ring of the sixth magnetic unit 2124 to an inner ring (e.g., a direction indicated by an arrow g on a right side of the first magnetic unit 2102 in the FIG. 24, the magnetization direction of the first magnetic unit 2102 may deflect 270 degrees in a clockwise direction). In some embodiments, the magnetization direction of the sixth magnetic unit 2124 may be the same as that of the fourth magnetic unit 2112 along a same vertical direction.

In some embodiments, at a position of the sixth magnetic unit 2124, an included angle between a direction of the magnetic field generated by the magnetic circuit assembly 2700 and a magnetization direction of the sixth magnetic unit 2124 maybe not greater than 90 degrees. In some embodiments, at the position of the sixth magnetic unit 2124, the included angle between the direction of the magnetic field generated by the first magnetic unit 2102 and the magnetized direction of the sixth magnetic unit 2124 may be less than or equal to 90 degrees, such as 0 degrees, 10 degrees, or 20 degrees.

In some embodiments, the included angle between a magnetization direction of the first magnetic unit 2102 and the magnetization direction of the seventh magnetic unit 2126 may be between 0 degrees and 180 degrees. In some embodiments, the included angle between the magnetization direction of the first magnetic unit 2102 and the magnetization direction of the seventh magnetic unit 2126 may be between 45 degrees and 135 degrees. In some embodiments, the included angle between the magnetization direction of the first magnetic unit 2102 and the magnetization direction of the seventh magnetic unit 2126 may be not greater than 90 degrees. In some embodiments, the magnetization direction of the first magnetic unit 2102 may be perpendicular to a lower surface or an upper surface of the first magnetic unit 2102 and be vertically upward (e.g., a direction indicated by the arrow a in FIG. 24). The magnetization direction of the seventh magnetic unit 2126 may be directed from the lower surface of the seventh magnetic unit 2126 to the upper surface (e.g., a direction indicated by an arrow f on a right side of the first magnetic unit 2102 in FIG. 24, the magnetization direction of the first magnetic unit 2102 may deflect 360 degrees in a clockwise direction). In some embodiments, a magnetization direction of the seventh magnetic unit 2126 may be opposite to that of the third magnetic unit 2110.

In some embodiments, at the position of the seventh magnetic unit 2126, the included angle between the direction of the magnetic field generated by magnetic circuit assembly 2700 and the direction of magnetization of the seventh magnetic unit 2126 may be not greater than 90 degrees. In some embodiments, at the position of the seventh magnetic unit 2126, the included angle between the direction of the magnetic field generated by the first magnetic unit 2102 and the magnetized direction of the seventh magnetic unit 2126 may be less than or equal to 90 degrees, such as 0 degrees, 10 degrees, or 20 degrees.

In the magnetic circuit assembly 2700, the third magnetically conductive unit 2116 may close the magnetic circuit generated by the magnetic circuit assembly 2700, so that more magnetic induction lines may be concentrated in the magnetic gap, thereby implementing the effect of suppressing the magnetic leakage, increasing the magnetic induction strength in the magnetic gap, and improving the sensitivity of a speaker device.

Figure 25:
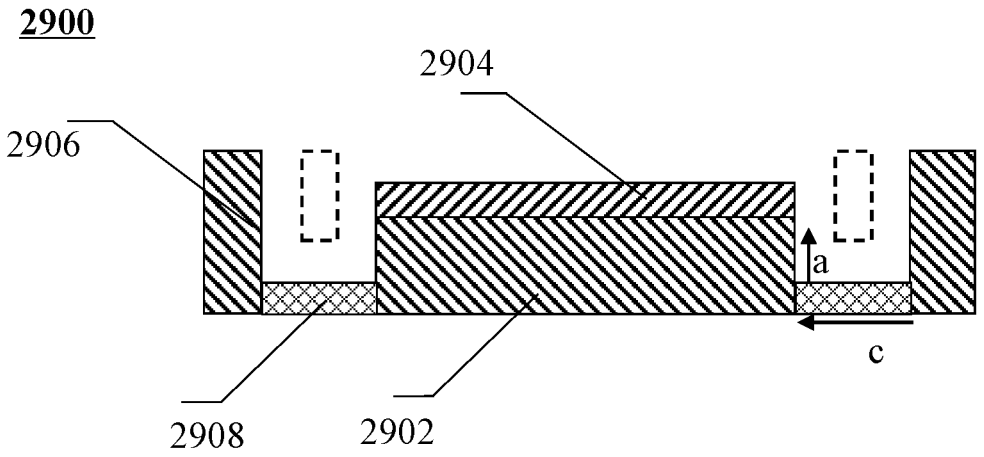
FIG. 25 is a schematic diagram illustrating a longitudinal sectional view of a magnetic circuit assembly according to some embodiments of the present disclosure.

FIG. 25 is a schematic diagram illustrating a longitudinal sectional view of a magnetic circuit assembly according to some embodiments of the present disclosure. As shown in FIG. 25, the magnetic circuit assembly 2900 may include a first magnetic unit 2902, a first magnetically conductive unit 2904, a first total magnetic field changing unit 2906, and a second magnetic unit 2908.

An upper surface of the first magnetic unit 2902 may be connected to a lower surface of the first magnetically conductive unit 2904. The second magnetic unit 2908 may be connected to the first magnetic unit 2902 and the first total magnetic field changing unit 2906. A connection manner between the first magnetic unit 2902, the first magnetically conductive unit 2904, the first total magnetic field changing unit 2906, and/or the second magnetic unit 2908 may include one or more connection manners described in the present disclosure. In some embodiments, the first magnetic unit 2902, the first magnetically conductive unit 2904, the first total magnetic field changing unit 2906, and/or the second magnetic unit 2908 may form a magnetic circuit and a magnetic gap.

In some embodiments, the magnetic circuit assembly 2900 may generate a first total magnetic field. The first magnetic unit 2902 may generate a second magnetic field. A magnetic field intensity of the first total magnetic field in the magnetic gap may be greater than a magnetic field intensity of the second magnetic field in the magnetic gap. In some embodiments, the second magnetic unit 2908 may generate a third magnetic field. The third magnetic field may increase the magnetic field intensity of the second magnetic field in the magnetic gap.

In some embodiments, an included angle between a magnetization direction of the first magnetic unit 2902 and a magnetization direction of the second magnetic unit 2908 may be between 0 degrees and 180 degrees. In some embodiments, the included angle between the magnetization direction of the first magnetic unit 2902 and the magnetization direction of the second magnetic unit 2908 may be between 45 degrees and 135 degrees. In some embodiments, the included angle between the magnetization direction of the first magnetic unit 2902 and the magnetization direction of the second magnetic unit 2908 maybe not greater than 90 degrees.

In some embodiments, at a position of the second magnetic unit 2908, an included angle between a direction of the first total magnetic field and the magnetization direction of the second magnetic unit 2908 maybe not greater than 90 degrees. In some embodiments, at the position of the second magnetic unit 2908, the included angle between the direction of the magnetic field generated by the first magnetic unit 2902 and the direction of magnetization of the second magnetic unit 2908 may be a less than or equal to 90 degrees, such as 0 degrees, 10 degrees, or 20 degrees. As another example, the magnetization direction of the first magnetic unit 2902 may be perpendicular to the lower surface or the upper surface of the first magnetic unit 2902 and be vertically upward (e.g., a direction indicated by an arrow a in FIG. 25). The magnetization direction of the second magnetic unit 2908 may be directed from an outer ring of the second magnetic unit 2908 to an inner ring (e.g., a direction indicated by an arrow c in FIG. 25 on the right side of the first magnetic unit 2902, and the magnetization direction of the first magnetic unit 2902 may deflect 270 degrees in a clockwise direction).

Compared with a magnetic circuit assembly with a single magnetic unit, the first total magnetic field changing unit 2906 in the magnetic circuit assembly 2900 may increase a total magnetic flux in the magnetic gap, thereby increasing the magnetic induction strength in the magnetic gap. In addition, under an action of the first total magnetic field changing unit 2906, originally scattered magnetic induction lines may converge to the position of the magnetic gap, thereby increasing the magnetic induction strength in the magnetic gap.

Figure 26:
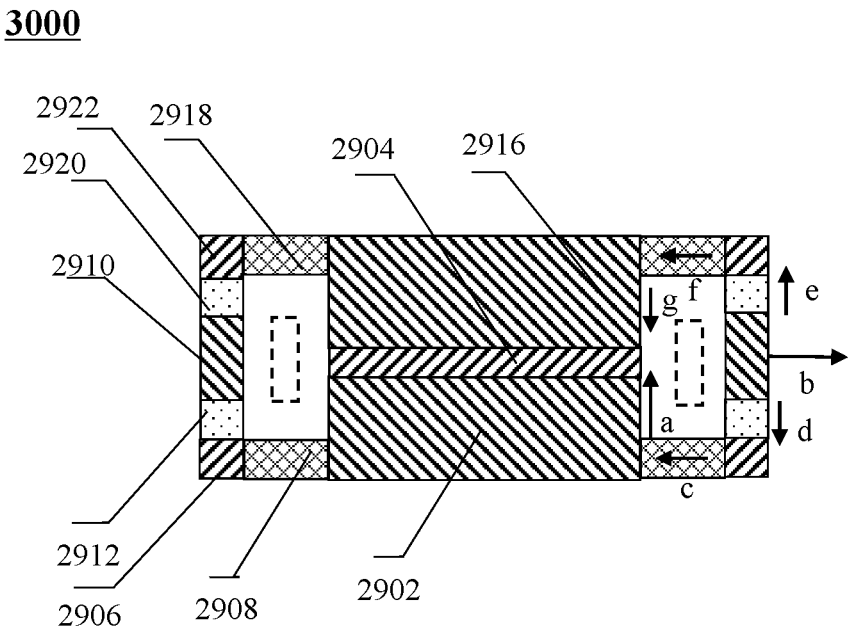
FIG. 26 is a schematic diagram illustrating a longitudinal sectional view of a magnetic circuit assembly according to some embodiments of the present disclosure.

FIG. 26 is a schematic diagram illustrating a longitudinal sectional view of a magnetic circuit assembly according to some embodiments of the present disclosure. As shown in FIG. 26, in some embodiments, the magnetic circuit assembly 3000 may include the first magnetic unit 2902, the first magnetically conductive unit 2904, the first total magnetic field changing unit 2906, the second magnetic unit 2908, a third magnetic unit 2910, a fourth magnetic unit 2912, a fifth magnetic unit 2916, a sixth magnetic unit 2918, a seventh magnetic unit 2920, and a second ring unit 2922. In some embodiments, the first total magnetic field changing unit 2906 and/or the second ring unit 2922 may include a ring-shaped magnetic unit or a ring-shaped magnetically conductive unit. The ring-shaped magnetic unit may include one or more magnetic materials described in the present disclosure. The ring-shaped magnetically conductive unit may include one or more magnetically conductive materials described in the present disclosure.

In some embodiments, the sixth magnetic unit 2918 may be connected to the fifth magnetic unit 2916 and the second ring unit 2922. The seventh magnetic unit 2920 may be connected to the third magnetic unit 2910 and the second ring unit 2922. In some embodiments, the first magnetic unit 2902, the fifth magnetic unit 2916, the second magnetic unit 2908, the third magnetic unit 2910, the fourth magnetic unit 2912, the sixth magnetic unit 2918, and/or the seventh magnetic unit 2920, the first magnetically conductive unit 2904, the first total magnetic field changing unit 2906, and the second ring unit 2922 may form a magnetic circuit.

In some embodiments, an included angle between the magnetization direction of the first magnetic unit 2902 and a magnetization direction of the sixth magnetic unit 2918 may be between 0 degrees and 180 degrees. In some embodiments, the angle between the magnetization direction of the first magnetic unit 2902 and the magnetization direction of the sixth magnetic unit 2918 may be between 45 degrees and 135 degrees. In some embodiments, the included angle between the magnetization direction of the first magnetic unit 2902 and the magnetization direction of the sixth magnetic unit 2918 maybe not greater than 90 degrees. In some embodiments, the magnetization direction of the first magnetic unit 2902 may be perpendicular to the lower surface or the upper surface of the first magnetic unit 2902 and be vertically upward (e.g., a direction indicated by an arrow a in FIG. 26). The magnetization direction of the sixth magnetic unit 2918 may be directed from an outer ring of the sixth magnetic unit 2918 to an inner ring (e.g., a direction indicated by an arrow f on a right side of the first magnetic unit 2902 in FIG. 26, the magnetization direction of the first magnetic unit 2902 may deflect 270 degrees in a clockwise direction). In some embodiments, in a same vertical direction, the magnetization direction of the sixth magnetic unit 2918 may be the same as that of the second magnetic unit 2908. In some embodiments, the magnetization direction of the first magnetic unit 2902 may be perpendicular to the lower surface or the upper surface of the first magnetic unit 2902 and be vertically upward (e.g., a direction indicated by the arrow a in FIG. 26). The magnetization direction of the seventh magnetic unit 2920 may be directed from the lower surface of the seventh magnetic unit 2920 to the upper surface (e.g., a direction indicated by an arrow e on the right side of the first magnetic unit 2902 in FIG. 26, the magnetization direction of the first magnetic unit 2902 may deflect 360 degrees in the clockwise direction). In some embodiments, a magnetization direction of the seventh magnetic unit 2920 may be the same as that of the fourth magnetic unit 2912.

In some embodiments, at a position of the sixth magnetic unit 2918, an included angle between a direction of a magnetic field generated by the magnetic circuit assembly 2900 and the magnetization direction of the sixth magnetic unit 2918 maybe not greater than 90 degrees. In some embodiments, at the position of the sixth magnetic unit 2918, the included angle between the direction of the magnetic field generated by the first magnetic unit 2902 and the direction of magnetization of the sixth magnetic unit 2918 may be less than or equal to 90 degrees, such as 0 degrees, 10 degrees, or 20 degrees.

In some embodiments, an included angle between the magnetization direction of the first magnetic unit 2902 and the magnetization direction of the seventh magnetic unit 2920 may be between 0 degrees and 180 degrees. In some embodiments, the included angle between the magnetization direction of the first magnetic unit 2902 and the magnetization direction of the seventh magnetic unit 2920 may be between 45 degrees and 135 degrees. In some embodiments, the included angle between the magnetization direction of the first magnetic unit 2902 and the magnetization direction of the seventh magnetic unit 2920 may be not greater than 90 degrees.

In some embodiments, at a position of the seventh magnetic unit 2920, an included angle between a direction of a magnetic field generated by the magnetic circuit assembly 3000 and the magnetization direction of the seventh magnetic unit 2920 may be not greater than 90 degrees. In some embodiments, at the position of the seventh magnetic unit 2920, an included angle between the direction of the magnetic field generated by the first magnetic unit 2902 and the direction of magnetization of the seventh magnetic unit 2920 may be less than or equal to 90 degrees, such as 0 degrees, 10 degrees, or 20 degrees.

In some embodiments, the first total magnetic field changing unit 2906 may include a ring-shaped magnetic unit. In this case, a magnetization direction of the first total magnetic field changing unit 2906 may be the same as the magnetization direction of the second magnetic unit 2908 or the magnetization direction of the fourth magnetic unit 2912. For example, on a right side of the first magnetic unit 2902, the magnetization direction of the first total magnetic field changing unit 2906 may be directed from an outer ring to an inner ring of the first total magnetic field changing unit 2906. In some embodiments, the second ring unit 2922 may include a ring-shaped magnetic unit. In this case, a magnetization direction of the second ring unit 2922 may be the same as that of the sixth magnetic unit 2918 or that of the seventh magnetic unit 2920. For example, on the right side of the first magnetic unit 2902, the magnetization direction of the second ring unit 2922 may be directed from an outer ring to an inner ring of the second ring unit 2922.

In the magnetic circuit assembly 3000, a plurality of magnetic units may increase the total magnetic flux. Different magnetic units may interact with each other, thereby suppressing the leakage of the magnetic induction lines, increasing the magnetic induction strength in the magnetic gap, and improving the sensitivity of the speaker device.

Figure 27:
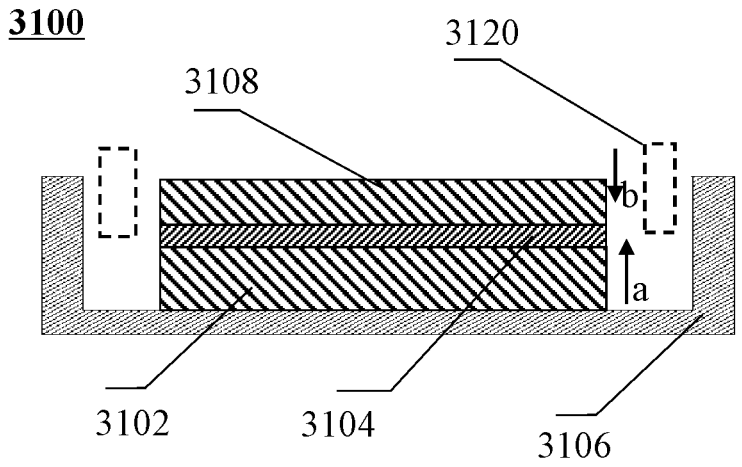
FIG. 27 is a structure diagram illustrating a longitudinal sectional view of a magnetic circuit assembly according to some embodiments of the present disclosure.

FIG. 27 is a structure diagram illustrating a longitudinal sectional view of a magnetic circuit assembly according to some embodiments of the present disclosure. As shown in FIG. 27, the magnetic circuit assembly 3100 may include a first magnetic unit 3102, a first magnetically conductive unit 3104, a second magnetically conductive unit 3106, and a second magnetic unit 3108.

In some embodiments, the first magnetic unit 3102 and/or the second magnetic unit 3108 may include one or more magnets described in the present disclosure. In some embodiments, the first magnetic unit 3102 may include a first magnet. The second magnetic unit 3108 may include a second magnet. The first magnet may be the same as or different from the second magnet. The first magnetically conductive unit 3104 and/or the second magnetically conductive unit 3106 may include one or more magnetically conductive materials described in the present disclosure. A processing manner of the first magnetically conductive unit 3104 and/or the second magnetically conductive unit 3106 may include one or more processing manners described in the present disclosure. In some embodiments, the first magnetic unit 3102, the first magnetically conductive unit 3104, and/or the second magnetic unit 3108 may be disposed as an axisymmetric structure. For example, the first magnetic unit 3102, the first magnetically conductive unit 3104, and/or the second magnetic unit 3108 may be cylinders. In some embodiments, the first magnetic unit 3102, the first magnetically conductive unit 3104, and/or the second magnetic unit 3108 may be coaxial cylinders with the same diameter or different diameters. A thickness of the first magnetic unit 3102 may be greater than or equal to a thickness of the second magnetic unit 3108. In some embodiments, the second magnetically conductive unit 3106 may have a groove-type structure. The groove-type structure may include a U-shaped section. The second magnetically conductive unit 3106 with the groove-type structure may include a bottom plate and a sidewall. In some embodiments, the bottom plate and the sidewall may be integrally formed as a whole. For example, the sidewall may be formed by extending the bottom plate in a direction perpendicular to the bottom plate. In some embodiments, the bottom plate may be connected to the sidewall through one or more connection manners described in the present disclosure. The second magnetic unit 3108 may be disposed as a ring shape or a sheet shape. The shape of the second magnetic unit 3108 may refer to descriptions elsewhere in the present disclosure. In some embodiments, the second magnetic unit 3108 may be coaxial with the first magnetic unit 3102 and/or the first magnetically conductive unit 3104.

An upper surface of the first magnetic unit 3102 may be connected to a lower surface of the first magnetically conductive unit 3104. A lower surface of the first magnetic unit 3102 may be connected to the bottom plate of the second magnetically conductive unit 3106. A lower surface of the second magnetic unit 3108 may be connected to an upper surface of the first magnetically conductive unit 3104. A connection manner between the first magnetic unit 3102, the first magnetically conductive unit 3104, the second magnetically conductive unit 3106, and/or the second magnetic unit 3108 may include one or more connection manners, such as a bonding manner, a snapping manner, a welding manner, a riveting manner, a bolting manner, or the like, or any combination thereof.

A magnetic gap may be formed between the first magnetic unit 3102, the first magnetically conductive unit 3104, and/or the second magnetic unit 3108 and the sidewall of the second magnetically conductive unit 3106. A voice coil may be disposed in the magnetic gap. In some embodiments, the first magnetic unit 3102, the first magnetically conductive unit 3104, the second magnetically conductive unit 3106, and the second magnetic unit 3108 may form a magnetic circuit. In some embodiments, the magnetic circuit assembly 3100 may generate a first total magnetic field. The first magnetic unit 3102 may generate a second magnetic field. The first total magnetic field may be formed by magnetic fields generated by components (e.g., the first magnetic unit 3102, the first magnetically conductive unit 3104, the second magnetically conductive unit 3106, and the second magnetic unit 3108) of the magnetic circuit assembly 3100. A magnetic field intensity (also referred to as magnetic induction strength or magnetic flux density) of the first total magnetic field in the magnetic gap may be greater than a magnetic field intensity of the second magnetic field in the magnetic gap. In some embodiments, the second magnetic unit 3108 may generate a third magnetic field. The third magnetic field may increase the magnetic field intensity of the second magnetic field in the magnetic gap.

In some embodiments, an included angle between a magnetization direction of the second magnetic unit 3108 and a magnetization direction of the first magnetic unit 3102 may be between 90 degrees and 180 degrees. In some embodiments, the included angle between the magnetization direction of the second magnetic unit 3108 and the magnetization direction of the first magnetic unit 3102 may be between 150 degrees and 180 degrees. In some embodiments, the magnetization direction (e.g., a direction indicated by an arrow a in FIG. 27) of the second magnetic unit 3108 may be opposite to the magnetization direction (e.g., a direction indicated by an arrow b in FIG. 27) of the first magnetic unit 3102.

Compared with a magnetic circuit assembly with a single magnetic unit, the magnetic circuit assembly 3100 may include the second magnetic unit 3108. The magnetization direction of the second magnetic unit 3108 may be opposite to the magnetization direction of the first magnetic unit 3102, which may suppress a magnetic leakage of the first magnetic unit 3102 in the magnetization direction. Relatively more magnetic field generated by the first magnetic unit 3102 may be compressed into the magnetic gap, thereby increasing the magnetic induction strength within the magnetic gap.

It should be noted that the description of the speaker device described above is merely for illustration purposes and should be not regarded as the only feasible implementation solution. Obviously, for those skilled in the art, after understanding the basic principle of the speaker device, it may be possible to make various modifications and changes in forms and details of the specific methods and operations of implementing the speaker device without departing from the principles. However, these modifications and changes are still within the scope of the present disclosure. For example, magnetic unit(s) in a magnetic circuit assembly is not limited to a first magnetic unit, a second magnetic unit, a third magnetic unit, a fourth magnetic unit, a fifth magnetic unit, a sixth magnetic unit, a seventh magnetic unit as described above. The number (or count) of the magnetic unit(s) may be decreased or increased according to an actual condition.

Figure 28:
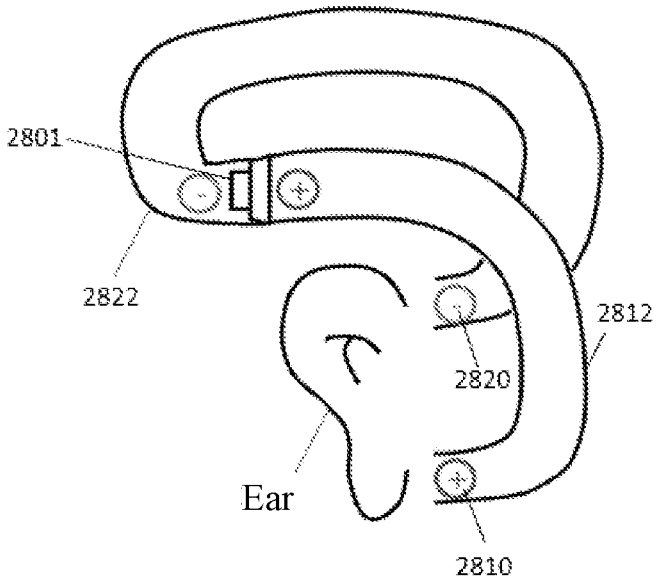
FIG. 28 is a schematic diagram illustrating sound transmission through air conduction according to some embodiments of the present disclosure.

In some embodiments, the speaker device (e.g., the MP3 player) described above may transmit the sound to the user through air conduction. When the air conduction is used to transmit the sound, the speaker device may include one or more sound sources. The sound source may be located at a specific position of the user's head, for example, the top of the head, a forehead, a cheek, a temple, an auricle, the back of an auricle, etc., without blocking or covering an ear canal. FIG. 28 is a schematic diagram illustrating transmitting sound through air conduction according to some embodiments of the present disclosure.

As shown in FIG. 28, a sound source 2810 and a sound source 2820 may generate sound waves with opposite phases ("+" and "−" in the figure may indicate the opposite phases). For brevity, the sound sources used herein may refer to sound outlets of a speaker device that outputs sounds. For example, the sound source 2810 and the sound source 2820 may be two sound outlets respectively located at a specific position (e.g., the core housing 20 or the circuit housing 30) of the speaker device.

In some embodiments, the sound source 2810 and the sound source 2820 may be generated by a same vibration device 2801. The vibration device 2801 may include a diaphragm (not shown in FIG. 28). When the diaphragm is driven to vibrate by an electric signal, a front side of the diaphragm may drive air to vibrate. The sound source 2810 may be formed at a sound output hole through a sound guiding channel 2812. A back side of the diaphragm may drive air to vibrate, and the sound source 2820 may be formed at the sound output hole through a sound guiding channel 2822. The sound guiding channel refers to a sound transmission route from the diaphragm to the corresponding outlet. In some embodiments, the sound guiding channel may be a route surrounded by a specific structure (e.g., the core housing 20 or the circuit housing 30) on the speaker device. It should be noted that in some alternative embodiments, the sound source 2810 and the sound source 2820 may be generated by different vibrating diaphragms of different vibration devices, respectively.

Among the sounds generated by the sound source 2810 and the sound source 2820, one portion of the sounds may be transmitted to the ear of a user to form a sound heard by the user. Another portion of the sound may be transmitted to the environment to form a leaked sound. Considering that the sound source 2810 and the sound source 2820 are relatively close to the ears of the user, for convenience of description, the sound transmitted to the ear of the user may be referred to as a near-field sound. The leaked sound transmitted to the environment may be referred to as a far-field sound. In some embodiments, the near-field/far-field sounds with different frequencies generated by the speaker device may be related to a distance between the sound source 2810 and the sound source 2820. Generally, the near-field sound generated by the speaker device may increase along with an increment of the distance between the two sound sources, and the far field sound (i.e., the leaked sound) may increase along with an increment of a frequency.

For sounds with different frequencies, the distance between the sound source 2810 and the sound source 2820 may be designed, respectively, so that a low-frequency near-field sound (e.g., a sound with a frequency less than 800 Hz) generated by the speaker device may be relatively great, and a far-field sound with the relatively high frequency (e.g., a sound with a frequency greater than 2000 Hz) may be relatively small. In order to implement the above purpose, the speaker device may include two or more sets of dual sound sources. Each set of the dual sound sources may include two sound sources similar to the sound source 2810 and the sound source 2820, and generate sounds with a specific frequency, respectively. Specifically, a first set of the dual sound sources may be used to generate a sound with a relatively low frequency. A second set of the dual sound sources may be used to generate a sound with a relatively great frequency. To increase a volume of the near-field sound with the relatively low frequency, the distance between two sound sources in the first set of the dual sound sources may be set with a relatively large value. Since the low-frequency near-field sound may have a relatively long wavelength, the relatively great distance between the two sound sources may not cause a relatively great phase difference in the far-field, and thereby reducing sound leakage in the far-field. In some embodiments, to reduce the far-field sound with the relatively high frequency, the distance between the two sound sources in the second set of the dual sound sources may be set with a relatively small value. Since the far field sound with the relatively high frequency may have a relatively short wavelength, the relatively small distance between the two sound sources may avoid the generation of a relatively large phase difference in the far-field, thereby reducing the sound leakage. The distance between the two sound sources of the second set of the dual sound sources may be less than the distance between the two sound sources of the first set of the dual sound sources.

The beneficial effects of the embodiments of the present disclosure may include but are not limited to the following. (1) Waterproof performance of a speaker device may be improved through sealed connections between various components of the speaker device in this present disclosure; (2) An elastic pad covering outside of a button hole may prevent the external liquid from entering into a circuit housing through the button hole, thereby improving the sealing and waterproof performance of a button mechanism of the speaker device; (3) An angle θ formed between a normal line A and a line B or between a normal line A' and a line B can be adjusted, thereby improving the sound quality of the speaker device; (4) By improving an overall rigidity of a housing of the speaker device, a housing panel and a housing back may keep the same or substantially the same vibration amplitude and phase at a relatively high frequency, thereby reducing the sound leakage of the speaker device; (5) The sensitivity of the speaker device is improved by adding magnetic unit(s), magnetically conductive unit(s), and electrically conductive unit(s) into magnetic units of the speaker device. It should be noted that different embodiments may have different beneficial effects. In different embodiments, the possible beneficial effects may be any one or a combination of the beneficial effects described above, or any other beneficial effects.

The basic concepts have been described above. Obviously, to those skilled in the art, the disclosure of the invention is merely by way of example and does not constitute a limitation on the present disclosure. Although not explicitly stated here, those skilled in the art may make various modifications, improvements, and amendments to the present disclosure. These alterations, improvements, and modifications are intended to be suggested by this disclosure and are within the spirit and scope of the exemplary embodiments of this disclosure.

We claim:

1. A speaker device comprising a core housing, a circuit housing, a button, an elastic pad, and an ear hook, wherein:

the core housing is configured to accommodate an earphone core, the core housing including a housing panel facing a human body and a housing back opposite to the housing panel, the earphone core being configured to cause the housing panel and the housing back to vibrate, a vibration of the housing panel having a first phase, a vibration of the housing back having a second phase, and an absolute value of a difference between the first phase and the second phase being less than 60 degrees when a frequency of each of the vibration of the housing panel and the vibration of the housing back is between 2000 Hz and 3000 Hz;

the circuit housing is configured to accommodate a control circuit, the control circuit being configured to cause the earphone core to vibrate to generate a sound;

the button is disposed at a button hole on the circuit housing, the button moving relative to the button hole to generate a control signal for the control circuit;

the elastic pad is disposed between the button and the button hole, the elastic pad being configured to hinder a movement of the button relative to the button hole; and the ear hook is configured to connect the core housing and the circuit housing.

2. The speaker device of claim 1, wherein the circuit housing includes a main sidewall and an auxiliary sidewall connected to the main sidewall, a first recessed area is disposed on the auxiliary sidewall, the elastic pad being disposed in the first recessed area, and the elastic pad includes a second recessed area corresponding to the button hole, the second recessed area extending to an inside of the button hole.

3. The speaker device of claim 2, wherein the button includes a button body and a button contact, the button contact extends into the second recessed area, and the button body is disposed on a side of the button contact away from the elastic pad.

4. The speaker device of claim 3, wherein the circuit housing accommodates a button circuit board, a button switch corresponding to the button hole is disposed on the button circuit board, and the button contact is configured to contact with and trigger the button switch when a user presses the button.

5. The speaker device of claim 3, wherein the button includes at least two button units disposed apart from each other and a connection part configured to connect the at least two button units, and the elastic pad includes an elastic convex configured to support the connection part.

6. The speaker device of claim 2, wherein the speaker device includes a rigid pad, the rigid pad is disposed between the elastic pad and the circuit housing, the rigid pad includes a through hole through which the second recessed area passes, and the elastic pad and the rigid pad are fixed against each other.

7. The speaker device of claim 1, wherein the ear hook is plugged and fixed to the circuit housing, a housing sheath is moulded on the ear hook, and the housing sheath is wrapped around a periphery of the circuit housing and a periphery of the button in a sleeved manner.

8. The speaker device of claim 7, wherein the housing sheath includes a bag-like structure with an opening end; and the circuit housing and the button enter into the housing sheath through the opening end of the housing sheath.

9. The speaker device of claim 8, wherein the opening end of the housing sheath includes an annular flange protruding inwardly, an end of the circuit housing away from the ear hook has a stepped structure to form an annular table, and the annular flange abuts on the annular table when the housing sheath covers the periphery of the circuit housing.

10. The speaker device of claim 9, wherein a sealant is applied to a joint area between the annular flange and the annular table to connect the housing sheath and the circuit housing in a sealed manner.

11. The speaker device of claim 4, wherein at least one mounting hole is disposed on the circuit housing, the speaker device further includes at least one conductive post each of which is inserted into one mounting hole of the at least one mounting hole;

a hollow region is disposed on the board, the board is disposed on an inner surface of the circuit housing, and the at least one mounting hole is disposed inside the hollow region to form a glue tank on a periphery of the at least one conductive post.

12. The speaker device of claim 11, wherein the hollow region includes a notch, a striped convex rib corresponding to the notch is integrally formed on an inner surface of the main sidewall, and the striped convex rib cooperates with the auxiliary film to make the glue tank closed.

13. The speaker device of claim 1, wherein the vibration of the housing panel has a first amplitude, the vibration of the housing back has a second amplitude, and a ratio of the first amplitude to the second amplitude is within a range of 0.5 to 1.5.

14. The speaker device of claim 1, wherein the vibration of the housing panel generates a first leaked sound wave, the vibration of the housing back generates a second sound leakage sound wave, and the first leaked sound wave and the second leaked sound wave overlap to reduce an amplitude of the first leaked sound wave.

15. The speaker device of claim 1, wherein the vibration caused by the earphone core generates a driving force;

the housing panel is connected to the earphone core via a transmission connection;

at least a portion of the housing panel is connected to or abuts against the human body of a user to transmit sound; and an area of the housing panel contacted with or abutting against the human body includes a normal line, a line where the driving force locates being not parallel to the normal line.

16. The speaker device of claim 15, wherein a positive direction of the line where the driving force locates is set outwards the speaker device from the housing panel, a positive direction of the normal line is set outwards the speaker device, and an angle formed between the positive direction of the line and the positive direction of the normal line is an acute angle.

17. The speaker device of claim 15, wherein the earphone core includes a coil and a magnetic circuit assembly, an axis of the coil or an axis of the magnetic circuit assembly is not parallel to the normal line, and the axis of the coil or the axis of the magnetic circuit assembly is perpendicular to a radial plane of the coil or a radial plane of the magnetic circuit assembly.

18. The speaker device of claim 1, wherein the earphone core further includes a magnetic circuit assembly, the magnetic circuit assembly generating a first magnetic field, the magnetic circuit assembly includes a first magnetic unit, a first magnetically conductive unit, and at least one second magnetic unit, the first magnetic unit generates a second magnetic field, and the at least one second magnetic unit surrounds the first magnetic unit, a magnetic gap is formed between the first magnetic unit and the at least one second magnetic unit, and an intensity of the first magnetic field in the magnetic gap is greater than an intensity of the second magnetic field in the magnetic gap.

19. The speaker device of claim 18, further comprising a second magnetically conductive unit and at least one third magnetic unit, wherein the at least one third magnetic unit is connected to the second magnetically conductive unit and the at least one second magnetic unit.

20. The speaker device of claim 19, wherein the first magnetically conductive unit is connected to an upper surface of the first magnetic unit, the second magnetically conductive unit includes a bottom plate and a sidewall, and the first magnetic unit is connected to the bottom plate of the second magnetically conductive unit.

* * * * *